US009621983B1

(12) United States Patent
Saati et al.

(10) Patent No.: US 9,621,983 B1
(45) Date of Patent: Apr. 11, 2017

(54) 100 TO 150 OUTPUT WATTAGE, 360 DEGREE SURROUND SOUND, LOW FREQUENCY SPEAKER, PORTABLE WIRELESS BLUETOOTH COMPATIBLE SYSTEM

(71) Applicant: Nima Saati, Irvine, CA (US)

(72) Inventors: Nima Saati, Irvine, CA (US); Jin Wen Li, Shenzhen (CN); Ming Fu Tseng, Shenzhen (CN); Chang Li Zhu, Shenzhen (CN); Jia Qun Fang, Shenzhen (CN); Bo Deng, Shenzhen (CN)

(73) Assignee: Nima Saati, Irvine, CA (US)

( * ) Notice: Subject to any disclaimer, the term of this patent is extended or adjusted under 35 U.S.C. 154(b) by 0 days.

(21) Appl. No.: 15/273,648

(22) Filed: Sep. 22, 2016

(51) Int. Cl.
*H04R 25/00* (2006.01)
*H04R 1/34* (2006.01)
(Continued)

(52) U.S. Cl.
CPC ..... *H04R 1/345* (2013.01); *H04R 1/2819* (2013.01); *H04R 3/14* (2013.01); *H04R 2420/07* (2013.01)

(58) Field of Classification Search
CPC . H04R 1/24; H04R 1/26; H04R 1/345; H04R 1/2826; H04R 2201/02; H04R 2201/023
See application file for complete search history.

(56) References Cited

U.S. PATENT DOCUMENTS 3,819,005 A * 6/1974 Westlund ..... G10K 11/28 181/153
3,931,867 A * 1/1976 Janszen ..... H04R 1/24 181/144
(Continued)

FOREIGN PATENT DOCUMENTS

CN 202004951 u 10/2011
CN 202261771 u 5/2012
(Continued)

*Primary Examiner* — Curtis Kuntz
*Assistant Examiner* — Ryan Robinson
(74) *Attorney, Agent, or Firm* — Knobbe, Martens, Olson & Bear, LLP

(57) ABSTRACT

An improved 360 degree surround sound performance, 100 to 150 output wattage, low frequency driver portable wireless, Bluetooth compatible system is disclosed utilizing a sound reflective surface. In this system, a sound enclosure is formed including inner and outer half-spherical shaped, side wall enclosures, and as a bottom surface an elevated horizontal base region. A low frequency mounted driver is facing downward and mounted within a downward facing aperture of the inner half-spherical spaced, side wall enclosures and within an inner surface of the elevated horizontal base region. A pair of oppositionally mounted drivers, facing outward is mounted within oppositionally mounted, side apertures of the inner spaced apart, half-spherical shaped, side wall enclosures. Half-spherical shaped bowls couple to a back portion of the oppositionally mounted, side apertures. A phase plug couples to side apertures of the outer spaced apart, half-spherical shaped, side wall enclosures via straps
(Continued)

and mounts in front of and spaced-apart from each of the pair of the oppositionally mounted drivers, facing outward.

21 Claims, 21 Drawing Sheets

(51) Int. Cl.
*H04R 1/28* (2006.01)
*H04R 3/14* (2006.01)

(56) References Cited

U.S. PATENT DOCUMENTS 4,157,741 A * 6/1979 Goldwater ..... H04R 1/30 181/156
4,872,854 A * 10/1989 Hesu ..... H04B 1/08 439/577
5,444,194 A * 8/1995 Reinke ..... H04R 1/028 181/150
6,580,801 B1 * 6/2003 Takagi ..... H04R 1/025 181/153
6,658,127 B1 * 12/2003 Kim ..... H04N 5/642 348/E5.13
7,441,630 B1 10/2008 Herrington et al.
8,706,043 B2 4/2014 Glezerman et al.
8,875,317 B2 11/2014 Jacobs
D730,316 S * 5/2015 Burchfield ..... D14/207
9,094,747 B2 7/2015 Rayner
9,143,861 B2 9/2015 Schul
9,148,714 B2 9/2015 Zhao
9,181,023 B2 11/2015 Clinton
9,197,951 B1 11/2015 Yang et al.
2008/0137880 A1 6/2008 Mills et al.
2011/0033066 A1 * 2/2011 Siegrist ..... G10H 1/32 381/118
2014/0098980 A1 4/2014 Kaetel
2014/0309058 A1 10/2014 San Juan
2015/0195635 A1 7/2015 Garfio et al.
2015/0245121 A1 8/2015 Chyzhov et al.
2015/0334481 A1 * 11/2015 Amae ..... H04R 1/02 381/386
2016/0057538 A1 * 2/2016 Clark ..... H04R 3/12 381/77
2016/0134964 A1 5/2016 Tracy

FOREIGN PATENT DOCUMENTS

CN 302242411 s 12/2012
CN 202976834 u 6/2013
CN 202998435 u 6/2013
CN 302909528 s 8/2014
CN 204046794 u 12/2014
CN 303387033 s 9/2015
CN 303423398 s 10/2015
CN 303453523 s 11/2015
CN 205360460 u 7/2016

* cited by examiner

100 TO 150 OUTPUT WATTAGE, 360 DEGREE SURROUND SOUND, LOW FREQUENCY SPEAKER, PORTABLE WIRELESS BLUETOOTH COMPATIBLE SYSTEM

COPYRIGHT NOTICE

One or more portions of this disclosure contains material which is subject to copyright protection. The copyright owner makes no objection to reproduction by anyone of this disclosure as disclosed in the Patent and Trademark Office files, record, or the like. Otherwise, the copyright owner reserves any and all copyright rights whatsoever for this patent disclosure. 37 CFR 1.71(d).

BACKGROUND OF THE DISCLOSURE

The following information may be useful in a better understanding of this disclosure. Please note that information contained in this section is not an admission that the information provided is material or prior art to this disclosure or as described in claimed disclosure, or that any publication or document that is specifically, implicitly or otherwise referenced is prior art.

1. Field of the Disclosure

The present disclosure relates generally to the field of portable speaker systems for cellular phones and handheld media devices and more specifically relates to a novel vibration reduction, 360 surround sound approach for a Bluetooth speaker system.

2. Description of the Related Art

Conventional portable wireless speaker systems include drivers and Bluetooth circuitry mounted in one or more housings or regions.

For example, CN205360460 discloses a portable Bluetooth speaker football including spheres. The bottom of the sphere has a through hole. The bottom surface of the lid covers the through hole and attached in the through hole. The bottom surface of the cover attached to the speaker. The speaker coupled to Bluetooth board and battery. The speaker affixed on the mounting bracket and affixed inside the sphere.

In another example, CN202998435 discloses a Bluetooth sound box with a 360-degree sound effect including a spherical shell and a speaker assembly arranged in the spherical shell with a sound outlet being arranged upward. The inner part of the spherical shell is further provided with a sound guide cone. The sound guide cone is located above the speaker assembly and separated from the speaker assembly. The sound guide cone protrudes toward the sound outlet and above the pilot tone of the speaker assembly and spaced from the speaker assembly.

In yet another example, CN202261771 discloses an induction sound production system and a sphere thereof. The induction sound production system comprises a sphere, a control system and a loudspeaker. The sphere comprises a dynamic induction module, a wireless emission module and a power supply module. The dynamic induction module is used for inducting movement of the sphere to obtain induction signals. The wireless emission module is used for transmitting induction signals. The power supply module is used for supplying power to the dynamic induction module and the wireless emission module. The control system comprises a wireless receiving module and a processing module. The wireless receiving module is used for receiving induction signals from the sphere. The processing module is used for processing the induction signals to obtain control signals. The loudspeaker is connected with the control system, wherein when the sphere moves, the processing module obtains the control signals according to the induction signals so as to further produce sound effect by controlling the loudspeaker through the control signal.

This prior art is representative of portable speaker systems including spherical cavities for cellular phones and handheld media devices.

None of the above disclosures and patents, taken either singly or in combination, is seen to describe the disclosure as claimed. Thus, a need exists for an improved Bluetooth® portable speaker system having any or all the following attributes, e.g., less complexity, e.g., less parts, improved performance capability, e.g., longer playing time, less vibration, improved 360 sound capability, high wattage output, better low frequency performance, within a more convenient means and a smaller footprint means, e.g., compact sized design, for mobile devices from one or more manufacturers, e.g., Iphone®, Ipad®, Android®, Samsung®, LG® electronics or the like, and to reduce or avoid many of the above-mentioned problems.

BRIEF SUMMARY OF THE DISCLOSURE

In view of the foregoing disadvantages inherent in the known portable speaker systems for cellular phones and handheld media devices art, the present disclosure provides a novel vibration reduction, 360 surround sound approach. The general purpose of the present disclosure, which will be described subsequently in greater detail, is to provide a specially designed portable speaker system that incorporates vibration reduction and 360 degree sound capabilities to provide consumers with a more compact, more aesthetically pleasing design portable device speaker system that provides sound enhancement properties, e.g., less vibration/better range frequency performance from a low frequency speaker, an improved 360 degree surround sound, high wattage output for low frequency sounds, larger range for high frequency sounds for a given speaker, and the like, for usage with one or more mobile or portable devices, e.g., Iphone®, Ipad®, Android®, or the like.

In one aspect, an improved 360 degree surround sound performance, 100 to 150 output wattage, low frequency driver, portable wireless, Bluetooth compatible system is disclosed. The system utilizes a sound reflective surface. For example, the sound reflective surface includes at least one of an adjacent surface, a table, and a stand. In this system, a sound enclosure is disclosed. The sound enclosure includes inner and outer half-spherical shaped, side wall enclosures. The sound enclosure includes as a bottom surface an elevated horizontal base region. The inner half-spherical shaped, side walls and the elevated horizontal base region form an air seal. For instance, the air seal prevents audio sound leakage from a low frequency driver about the sound enclosure. Advantageously, the air seal maintains a substantially consistent level of 360 degree sound performance independent of a covering size or a shape of the outer half-spherical shaped, side wall enclosures. A low frequency driver is mounted facing downward within a downward facing aperture of the inner half-spherical spaced, side wall enclosures and coupled to an inside surface of the elevated horizontal base region. A pair of oppositionally mounted drivers is facing outward and mounted within oppositionally mounted, side apertures of the inner spaced apart, half-spherical shaped, side wall enclosures. Half-spherical-shaped bowls couple to a back portion of the oppositionally mounted, side apertures. The half-spherical shaped bowls extend a high frequency range of the pair of oppositionally mounted drivers, facing outward. For example, each driver of the pair of oppositionally mounted drivers, facing outward includes a paper cone and the half-spherical shaped bowls extend the paper cones high frequency range. A phase plug couples to side apertures of the outer half-spherical shaped, side wall enclosures via straps or stays and mounted in front of and spaced-apart from each of the pair of the oppositionally mounted drivers, facing outward, the phase plug having on a back side a flat-bottom teardrop shaped structure.

In another aspect, an improved 360 degree surround sound performance, 100 to 150 output wattage, system is disclosed. The system includes a low frequency driver portable wireless, Bluetooth compatible system. The system utilizes a sound reflective surface including at least one of an adjacent surface, a table, and a stand. In this system, a sound enclosure includes inner and outer half-spherical shaped, side wall enclosures, and as a bottom surface an elevated horizontal base region. The inner half-spherical shaped, side walls and the elevated horizontal base region form an air seal.

Advantageously, the air seal maintains a substantially consistent level of 360 degree sound performance independent of a covering size or a shape of the outer half-spherical shaped, side wall enclosures. A low frequency driver is facing downward within a downward facing aperture of the inner half-spherical spaced, side wall enclosures and mounted on an inside surface of the elevated horizontal base region. Advantageously, low frequency sounds emitted by the low frequency driver reflect from the sound reflective surface, e.g., lower adjacent surface, the elevated horizontal base region faces and enhance and extend a bass range of the low frequency driver.

In some embodiments of the other aspect, the system includes a sound port having a hollow, curved channel mounted within the sound enclosure at one end proximally located to a back portion of the low frequency driver and the at another end mounted to a sound port opening proximal to a vent cover of the elevated horizontal base region and coupled through the elevated horizontal base region. Advantageously, the vent cover and sound port enhances a volume of and extends a low frequency range, and lowers a resonant frequency of an audio response of the sound enclosure. For example, in some embodiments, the vent cover and sound port enhances a volume of, e.g., doubling volume up to 6 dB, extends a low frequency range, and lowers a resonant frequency of the low frequency driver. For example, extend a low frequency range between approximately 5% to 15% of an operational frequency range of the low frequency driver, and/or lower a resonant frequency between approximately 5% to 15% of an operational frequency range of the low frequency driver. In some embodiments, the low frequency driver includes an operational frequency range between approximately 20 Hz to 60 Hz.

In some embodiments of the other aspect, the system comprising a pair of oppositionally mounted drivers, facing outward and mounted within oppositionally mounted, side apertures of the inner spaced apart, half-spherical shaped, side wall enclosures. Advantageously, the oppositionally mounted, side apertures include half-spherical shaped bowls that cover a back portion of the oppositionally mounted, side apertures, and extend a high frequency range of the pair of oppositionally mounted drivers, facing outward. For example, the high frequency range is extended by the half-spherical shaped bowls for each of the pair of oppositionally mounted drivers, facing outward including a paper cone. For example, extend a high frequency range between 5% to 15% of an operational frequency range of the pair of oppositionally mounted frequency drivers. In some embodiments, the oppositionally mounted drivers have an operational frequency range between approximately 20 Hz to 20,000 Hz. Advantageously, the high frequency energy, e.g., high frequency sounds, are delivered by the half-spherical shaped bowls instead of the oppositionally mounted drivers.

In some embodiments of the other aspect, a phase plug couples to side apertures of the outer half-spherical shaped, side wall enclosures via straps and mounted in front of and spaced-apart from each of the pair of the oppositionally mounted drivers, facing outward. In some embodiments, the phase plug includes on a back side a flat-bottom teardrop shaped structure. Advantageously, in one embodiment, the phase plug extends a high frequency response through guiding audio waves outward toward a listener and prevents the audio waves being destructively interfered near the pair of the oppositionally mounted drivers, facing outward. Advantageously, in one embodiment, the phase plug includes on a back side a flat-bottom teardrop shaped structure that extends a high frequency response through guiding audio waves outward toward a listener and prevents the audio waves being destructively interfered near the pair of the oppositionally mounted drivers, facing outward. In yet another example of the another aspect, a phase plug couples to side apertures of the outer half-spherical shaped, side wall enclosures via straps and mounted in front of and spaced-apart from each of the pair of the oppositionally mounted drivers, facing outward. In yet another example of the another aspect, a phase plug having on a back side a flat-bottom teardrop shaped structure couples to side apertures of the outer half-spherical shaped, side wall enclosures via straps and mounted in front of and spaced-apart from each of the pair of the oppositionally mounted drivers, facing outward. Advantageously, in one example, the phase plug plus on a back side a flat-bottom teardrop shaped structure equalizes sound wave path lengths from each of the pair of the oppositionally mounted drivers to a listener and prevents high frequency sound cancellation and improves frequency response of the pair of oppositionally mounted drivers, facing forward.

In some embodiments, the low frequency driver includes an operational frequency range between approximately 20 Hz to 60 Hz and the oppositionally mounted drivers have an operational frequency range between approximately 20 Hz to 20,000 Hz.

The present disclosure holds significant improvements and serves as a portable speaker system and method for mobile devices. As described herein, it is to be understood that not necessarily advantages, and novel features may be achieved in accordance with any one particular embodiment of the disclosure. Thus, the disclosure can be embodied or carried out in a manner that optimizes or achieves one or a group thereof of advantages as taught herein without achieving many or all advantages as may be taught or suggested. Features of the disclosure which are believed to be novel are distinctly claimed in the specification. It should be noted that the drawing figures may be in simplified form and might not be to precise scale. In reference to the disclosure herein, for purposes of convenience and clarity only, directional terms such as top, bottom, left, right, up, down, over, above, below, beneath, rear, front, distal, and proximal are used with respect to the accompanying drawings. Such directional terms should not be construed to limit the scope of the embodiment in any manner.

BRIEF DESCRIPTION OF THE DRAWINGS

The figures which accompany the written portion of this specification illustrate embodiments and method(s) of use for the present disclosure of an Improved 360 Degree Surround Sound Portable Speaker System and Method for a mobile device, e.g., cellular phone and handheld media devices art, constructed and operative according to the teachings of the present disclosure.

The various embodiments of the present disclosure will hereinafter be described in conjunction with the appended drawings, wherein like designations denote like elements.

DETAILED DESCRIPTION

Figure 1:
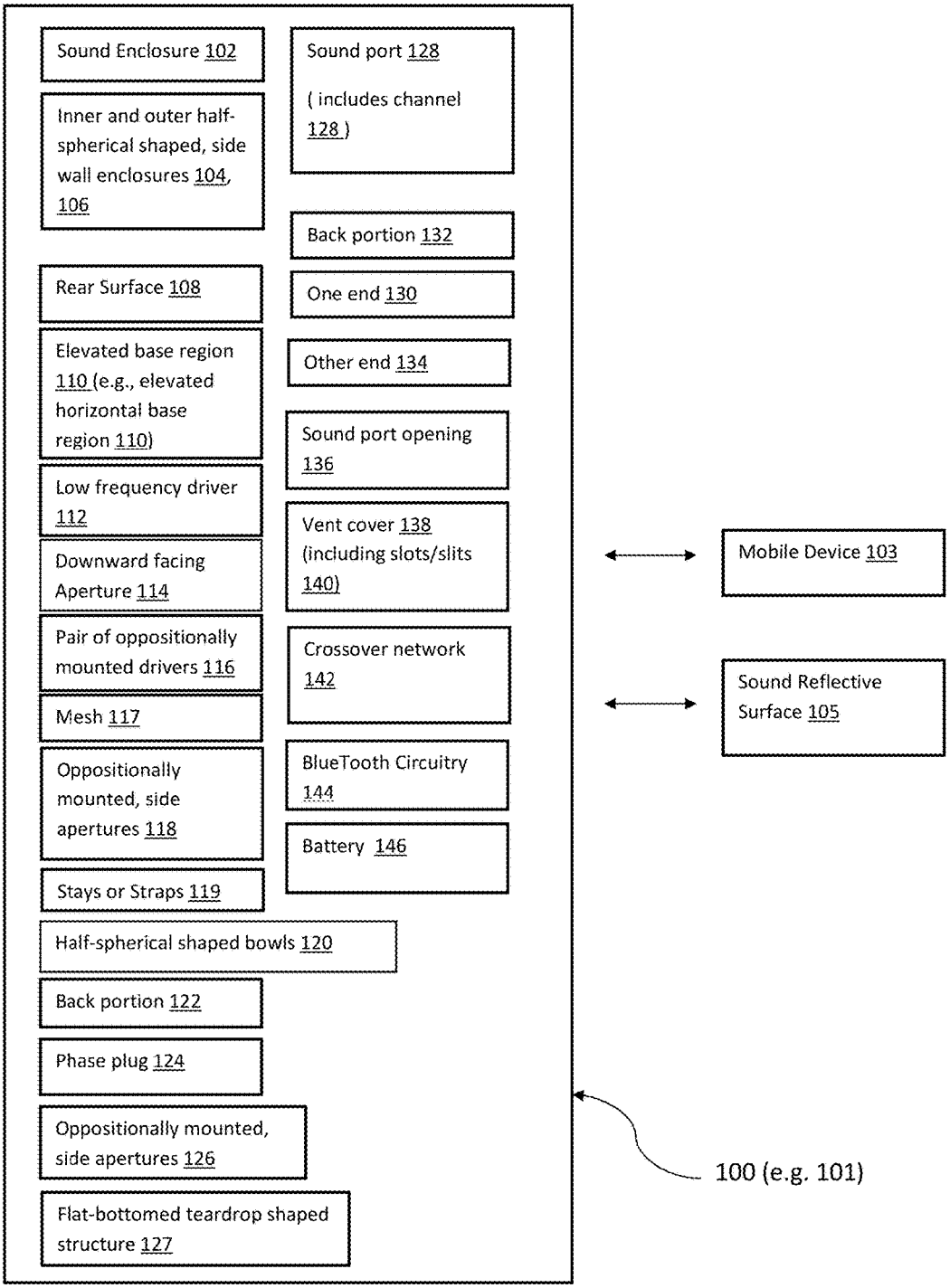
FIG. 1 shows a block diagram 100 illustrating Improved 360 Degree Surround Sound Portable Speaker System 100 according to an embodiment of the present disclosure.

As discussed above, embodiments of the present disclosure relate to the field of portable speaker systems for cellular phones and handheld media devices and more specifically relates to a novel 360 surround sound approach for a Bluetooth speaker system.

Referring to the drawings by numerals of reference there is shown in FIGS. 1-21, as discussed above, embodiments of the present disclosure relate to portable speaker systems for cellular phones and handheld media devices. Generally speaking, Bluetooth portable speaker is a specially designed mobile device, e.g., portable speaker system, that incorporates an inner and outer half-spherical shaped, side wall enclosures and a horizontal base region as part of a sound enclosure that improves sound quality, e.g., sound vibrations caused by a low frequency speaker, and provides 360 degree sound effect capabilities including side-mounted, oppositional speakers for consumers, e.g., listeners, with a more convenient, reduced volume and size, and attractive means of providing loud speakers for portable devices including telephones and mobile devices, e.g., Iphone®, Ipad®, Android®, laptop computers and the like.

Referring now to drawings including FIG. 1, an improved 360 degree surround sound performance, 100 to 150 output wattage, low frequency driver 112 portable wireless, Bluetooth compatible system 100 utilizing a sound reflective surface 105 including at least one of an lower adjacent surface, a table, and a stand. In the system 100, a sound enclosure 102 includes inner and outer half-spherical shaped, side wall enclosures 104, 106, and as a bottom surface an elevated base region 110, e.g., elevated horizontal base region 110.

Advantageously, the inner half-spherical shaped, side wall enclosures 104 and the elevated horizontal base region 110 form an air seal. A low frequency driver 112 facing downward within a downward facing aperture 114 of the inner half-spherical spaced, side wall enclosures 104 and on or about a rear surface 108 of the elevated base region 110, e.g., elevated horizontal base region 110. In some embodiments, the downward facing aperture 114 of the rear surface 108 is substantially parallel, e.g., substantially facing, to the sound reflective surface 105 so as to position the low frequency driver 112 substantially parallel, e.g., substantially facing, to the sound reflective surface 105. In some embodiments, the downward facing aperture 114 of the rear surface 108 is located at an approximate relative angle between 2 to 30 degrees relative from parallel, e.g., facing, to the sound reflective surface 105. Advantageously, in some embodiments, the approximate relative angle, e.g., an angle between 1 to 45 degrees relative from parallel, e.g., facing, to the sound reflective surface 105, may selected, e.g., during design/manufacturing product design, and before final product launch to maximize output low frequency output power of the low frequency driver 112.

A pair of oppositionally mounted drivers 116, facing outward and mounted within oppositionally mounted, side apertures 118 of the inner spaced apart, half-spherical shaped, side wall enclosures 104. Half-spherical-shaped bowls 120 couple to a back portion 122 of the oppositionally mounted, side apertures 118. Advantageously, half-spherical shaped bowls 120 extend a high frequency range of the pair of oppositionally mounted drivers 116, facing outward. In one example, the half-spherical shaped bowls 120 extend a high frequency range of the pair of oppositionally mounted drivers 116 having a paper cone that may otherwise experience high stress conditions, e.g., breakup vibration, caused when emitting sounds, e.g., audio sounds, at a high end of the high frequency range.

In some embodiments, half-spherical shaped bowls 120 extend a high frequency range between approximately 5% to 15% of an operational frequency range of the pair of oppositionally mounted frequency drivers 116. In some embodiments, the oppositionally mounted drivers 116 have an operational frequency range between approximately 20 Hz to 20,000 Hz. In some embodiments, advantageously, the half-spherical shaped bowls 120 provide a level of sound isolation between sounds emitted by the oppositionally mounted drivers 116 and those sounds from the low frequency driver 112.

A phase plug 124 couples to sides of the oppositionally mounted, side apertures 126 of the outer half-spherical shaped, side wall enclosures 106, using stays or straps 119, e.g., plastic, leather, nylon, or the like stays or straps 119, and mounted in front of and spaced-apart from each of the pair of the oppositionally mounted drivers 116 facing outward. In one example, the phase plug 124 includes on a back side a flat-bottom teardrop shaped structure 127.

Advantageously, in one example, the phase plug 124 including on a back side a flat-bottom teardrop shaped structure 127 extends a high frequency response through guiding audio waves outward toward a listener and prevents the audio waves being destructively interfered near the pair of the oppositionally mounted drivers 116, facing outward. In yet another example of the another aspect, a phase plug 124 couples to side apertures 126 of the outer half-spherical shaped, side wall enclosures 106 via straps 119 and mounted in front of and spaced-apart from each of the pair of the oppositionally mounted drivers 116, facing outward. In yet another example of the another aspect, a phase plug 124 having on a back side a flat-bottom teardrop shaped structure 127 couples to side apertures of the outer half-spherical shaped, side wall enclosures 106 via straps 119 and mounted in front of and spaced-apart from each of the pair of the oppositionally mounted drivers 116, facing outward. Advantageously, in one example, the phase plug 124 plus on a back side a flat-bottom teardrop shaped structure 127 equalizes sound wave path lengths from each of the pair of the oppositionally mounted drivers 116 to a listener and prevents high frequency sound cancellation and improves frequency response of the pair of oppositionally mounted drivers 116, facing forward.

A sound port 128 includes hollow, curved channel, e.g., plastic, two pieces, snap-together and mounted within the sound enclosure 102. For example the sound port 128 at one end 130 proximally located to a back portion 132 of the low frequency driver 112 and the at another end 134 mounted to a sound port opening 136 proximal to a vent cover 138 of the elevated base region 110, e.g., elevated horizontal base region 110, and coupled through the elevated base region 110, e.g., elevated horizontal base region 110.

Advantageous, the vent cover 138, e.g., including open slots or slits 140, and sound port 128 enhances a volume of and extends a low frequency range, and lowers a resonant frequency of an audio response of the sound enclosure 102.

For example, in some embodiments, the vent cover 138 and sound port 128 enhances a volume of, e.g., doubling volume up to 6 dB, extends a low frequency range, and lowers a resonant frequency of the low frequency driver 112. For example, extend a low frequency range between 5% to 15% of an operational frequency range of the low frequency driver 112, and/or lower a resonant frequency between 5% to 15% of an operational frequency range of the low frequency driver 112. In some embodiments, the low frequency driver 112 includes an operational frequency range between approximately 20 Hz to 60 Hz.

In some embodiments, a crossover network 142 includes audio amplifiers and filters that separates and amplifies high frequency and low frequency audio signals respectively for each of the pair of oppositionally mounted drivers 116 and the low frequency driver 112.

In some embodiments, each of the pair of oppositionally mounted drivers 116 is chosen with a magnetic weight and low frequency audio properties that reduces vibration of the sound enclosure 102 when the low frequency driver 112 is operational. In some embodiments, the outer half-spherical shaped, side wall enclosures 106 and as a bottom surface an elevated horizontal base region 110 form an outward shape and appearance, e.g., including logo of local, regional, state, national, or internationally recognized sports team, of at least one of a sports helmet, a baseball, a basketball, and a soccer ball.

In some embodiments, the pair of oppositionally mounted drivers 116 has an aperture size smaller than that of the aperture size of the low frequency driver 112. In some embodiments, the low frequency driver 112 includes an operational frequency range between approximately 20 Hz to 60 Hz and the oppositionally mounted drivers 116 have an operational frequency range between approximately 20 Hz to 20,000 Hz. In some embodiments, the outer half-spherical shaped, side wall enclosures 106 and an elevated horizontal base region 110 form an outward shape and appearance, e.g., including logo of local, regional, state, national, or internationally recognized sports team, of at least one of a sports helmet, a baseball, a basketball, and a soccer ball; the pair of oppositionally mounted drivers 116 includes NIMA wireless speakers; the low frequency driver 112 includes a NIMA wireless speaker; and the crossover network 142 includes a first crossover point between 20 to 60 Hz for the low frequency driver 112 and the pair of oppositionally mounted drivers 116 and adjustable properties.

In some embodiments, Bluetooth circuitry 144 wirelessly connects the system 100 to a mobile communication device 103; wherein the low frequency driver 112 is a subwoofer and the pair of oppositionally mounted drivers 116 is full-range speakers.

Advantageously, in some embodiments, as illustrated most notably in the FIGS. 9-14, the flat-bottom teardrop shaped structure 127, the phase plug 124, the sound port 128, and the half-spherical shaped bowls 102, e.g., of 10 inch diameter enclosure, can be dimensioned in accordance with size of inner and outer half-spherical shaped, sidewall enclosures 104, 106 so as to maximize sound output, minimize sound reflections, and improve overall sound performance of both low frequency driver 112 and oppositionally mounted driver 116 in accordance with size of a sound enclosure 120, e.g., e.g., 2.5 inch diameter (small, FIGS. 9 and 10), 5 inch diameter (medium, FIGS. 11 and 12), and 10 inch diameter (large, FIGS. 13, 14, and 15) sound enclosure 102.

In one system 100, an improved 360 degree surround sound performance, 100 to 150 output wattage, low frequency driver portable wireless, Bluetooth compatible system 100 utilizing a sound reflective surface 105 including at least one of an lower adjacent surface, a table, and a stand.

In the system 100, a sound enclosure 102 includes inner and outer half-spherical shaped, side wall enclosures 104, 106, and a bottom surface as an elevated horizontal base region 110. Advantageously, the inner half-spherical shaped, side wall enclosures 104 and the elevated horizontal base region 110 form an air seal that maintains a substantially consistent level of 360 degree sound performance independent of a covering size or a shape of the outer side wall enclosures 106.

A low frequency driver 112 mounted facing downward within a downward facing aperture 114 of the inner half-spherical spaced, side wall enclosures 104 on or about a rear surface 108 of the elevated base region 110, e.g., elevated horizontal base region 110. Advantageously, low frequency sounds emitted by the low frequency driver 112 reflect from the reflective surface 105, e.g., lower adjacent surface 105, the elevated base region 110, e.g., elevated horizontal base region 110, faces and enhance and extend a bass range of the low frequency driver 112.

Advantageously, in some embodiments, the approximate relative angle, e.g., an angle between 5 to 45 degrees as measured from the elevated base region 110, e.g., elevated horizontal base region 110, of the low frequency driver 112 of the rear surface 108 may selected, e.g., during design/manufacturing product design, and before final product launch to maximize output low frequency output power of the low frequency driver 112.

In some embodiments, the downward facing aperture 114 of the rear surface 108 is substantially parallel, e.g., substantially facing, to the sound reflective surface 105 so as to position the low frequency driver 112 substantially parallel, e.g., substantially facing, to the sound reflective surface 105. In some embodiments, the downward facing aperture 114 of the rear surface 108 is located at an approximate relative angle between 2 to 30 degrees relative from parallel, e.g., facing, to the sound reflective surface 105. Advantageously, in some embodiments, the approximate relative angle, e.g., an angle between 1 to 45 degrees relative from parallel, e.g., facing, to the sound reflective surface 105, may selected, e.g., during design/manufacturing product design, and before final product launch to maximize output low frequency output power of the low frequency driver 112.

A sound port 128 includes a hollow, curved channel mounted within the sound enclosure 102 at one end 130 proximally located to a back portion 132 of the low frequency driver 112 and the at another end 134 mounted to a sound port opening 136 proximal to a vent cover 138 of the elevated horizontal base region 110 and coupled through the elevated horizontal base region 110. Advantageously, vent cover 138 and sound port 128 enhances a volume of and extends a low frequency range, and lowers a resonant frequency of an audio response of the sound enclosure 102. For example, in some embodiments, the vent cover 138 and sound port 128 enhances a volume of, e.g., doubling volume up to 6 dB, extends a low frequency range, and lowers a resonant frequency of the low frequency driver 112. For example, extend a low frequency range between 5% to 15% of an operational frequency range of the low frequency driver 112, and/or lower a resonant frequency between 5% to 15% of an operational frequency range of the low frequency driver 112. In some embodiments, the low frequency driver 112 includes an operational frequency range between approximately 20 Hz to 60 Hz.

A pair of oppositionally mounted drivers 116 faces outward and mounts within oppositionally mounted, side apertures 118 of the inner half-spherical shaped, side wall enclosures 104. In some embodiments, the oppositionally mounted, side apertures 118 include half-spherical shaped bowls 120 that cover a back portion 122 of the oppositionally mounted, side apertures 118, and extend a high frequency range of the pair of oppositionally mounted drivers 116, facing outward. In one example, the pair of oppositionally mounted drivers 116, facing outward includes a paper cone. In some embodiments, the half-spherical shaped bowls 120 provide a level of sound isolation between the oppositionally mounted drivers 116 and the low frequency driver 112.

For example, extend a high frequency range between 5% to 15% of an operational frequency range of the pair of oppositionally mounted frequency drivers 116. In some embodiments, the oppositionally mounted drivers 116 have an operational frequency range between approximately 20 Hz to 20,000 Hz. In some embodiments, the half-spherical shaped bowls 120 provide a level of sound isolation between the oppositionally mounted drivers 116 and the low frequency driver 112.

A phase plug 124 couples to oppositionally mounted, side apertures 126 of the outer half-spherical shaped, side wall enclosures 106 via straps or stays 119 and mounted in front of and spaced-apart from each of the pair of the oppositionally mounted drivers 116, facing outward. Advantageously, the phase plug 124 extends a high frequency response through guiding audio waves outward toward a listener and prevents the audio waves being destructively interfered near the pair of the oppositionally mounted drivers 116, facing outward.

In some embodiments, a phase plug 124 couples to oppositionally mounted, side apertures 126 of the outer half-spherical shaped, side wall enclosures 106 via straps or stays 119 and mounted in front of and spaced-apart from each of the pair of the oppositionally mounted drivers 116, facing outward. Advantageously, the phase plug 124 equalizes sound wave path lengths from each of the pair of the oppositionally mounted drivers 116 to the listener and prevents high frequency sound cancellation and improves frequency response of the pair of oppositionally mounted drivers 116.

Advantageously, in one example, the phase plug 124 includes on a back side a flat-bottom teardrop shaped structure 127 that extends a high frequency response through guiding audio waves outward toward a listener and prevents the audio waves being destructively interfered near the pair of the oppositionally mounted drivers 116, facing outward. Advantageously, in some embodiments, as illustrated most noteably in the FIGS. 9-14, the flat-bottom teardrop shaped structure 127, the phase plug 124, the sound port 128, and the half-spherical shaped bowls 102, e.g., of 10 inch diameter enclosure, can be dimensioned in accordance with size of inner and outer half-spherical shaped, sidewall enclosures 104, 106 so as to maximize sound output, minimize sound reflections, and improve overall sound performance of both low frequency driver 112 and oppositionally mounted driver 116 in accordance with size of a sound enclosure 120, e.g., e.g., 2.5 inch diameter (small, FIGS. 9 and 10), 5 inch diameter (medium, FIGS. 11 and 12), and 10 inch diameter (large, FIGS. 13, 14, and 15) sound enclosure 102.

Advantageously, the phase plug 124 includes on a back side a flat-bottom teardrop shaped structure 127 that extends a high frequency response through guiding audio waves outward toward a listener and prevents the audio waves being destructively interfered near the pair of the oppositionally mounted drivers 116, facing outward. In yet another example of the another aspect, a phase plug 124 couples to side apertures 126 of the outer half-spherical shaped, side wall enclosures 106 via straps 119 and mounted in front of and spaced-apart from each of the pair of the oppositionally mounted drivers 116, facing outward.

In yet another example of the another aspect, a phase plug 124 having on a back side a flat-bottom teardrop shaped structure 127 couples to side apertures of the outer half-spherical shaped, side wall enclosures 106 via straps 119 and mounted in front of and spaced-apart from each of the pair of the oppositionally mounted drivers 116, facing outward. Advantageously, in one example, the phase plug 124 plus on a back side a flat-bottom teardrop shaped structure 127 equalizes sound wave path lengths from each of the pair of the oppositionally mounted drivers 116 to a listener and prevents high frequency sound cancellation and improves frequency response of the pair of oppositionally mounted drivers 116, facing forward.

In some embodiments, a crossover network 142 is disclosed including audio amplifiers and filters that separate and amplify high frequency and low frequency audio signals respectively for each of the pair of oppositionally mounted drivers 116 and the low frequency driver 112. In one example, each of the pair of oppositionally mounted drivers 116 is chosen with a magnetic weight and low frequency audio properties that reduces vibration of the sound enclosure 102 when the low frequency driver 112 is operational.

In some embodiments, the sound enclosure 102 includes an outward shape and appearance, e.g., including logo of local, regional, state, national, or internationally recognized sports team, of at least one of a sports helmet, a baseball, a basketball, and a soccer ball. In some embodiments, the pair of oppositionally mounted drivers 116 has an aperture size smaller than that of an aperture size of the low frequency driver 112.

In some embodiments, the low frequency driver 112 includes an operational frequency range between approximately 20 Hz to 60 Hz and the oppositionally mounted drivers 116 have an operational frequency range between approximately 20 Hz to 20,000 Hz.

In some embodiments, the sound enclosure 102 includes an outward shape and appearance, e.g., including logo of local, regional, state, national, or internationally recognized sports team, of at least one of a sports helmet, a baseball, a basketball, and a soccer ball; the pair of oppositionally mounted drivers 116 includes NIMA wireless speakers; the low frequency driver 112 includes a NIMA wireless speaker; and the crossover network 142 includes a first crossover point between 20 to 60 Hz for the low frequency driver 112 and the pair of oppositionally mounted drivers 116 with operation frequency range of 20 HZ to 20,000 Hz and in some embodiments, adjustable frequency properties or cut-off filtering and sound amplification.

In some embodiments, Bluetooth circuitry 144 wirelessly connects the system to a mobile communication device; wherein the low frequency driver 112 is a subwoofer and the pair of oppositionally mounted drivers 116 is full-range speakers.

Advantageously, because of the air seal as disclosed herein, e.g., i.e., pre-treated seal-up including an inner enclosure, e.g., formed by inner half-spherical shaped, side walls enclosures 104 and elevated base region 110, that is a separate enclosure from that of outer enclosure, e.g., formed by outer half-spherical shaped, side wall enclosures 106 and elevated base region 110, system 100 may be utilized as a true wireless stereo system with your mobile device 103.

As such, advantageously, a listener can pair two "2" system 100 together, e.g., surround themselves, for example, with each system 100 of the pair with a 50% volume level, with a rich, full range and robust true 360 performance, powerful, high definition, listening experience, when transmitting, for example, music, video, or recording through, for example, using Bluetooth technology on the mobile device 103 to each of the pair of system 100 using Bluetooth Circuitry 144.

For example, for a consumer product 101 using system 100 having an approximately 2.5 inch diameter helmet (e.g., small helmet) would include the following dimensions:

i.) inner half-spherical shaped, side wall enclosures 104 span an approximate surface area of 12.57 inches$^2$ (approximately 1 inch radius) and an approximate volume of 4.19 inches$^3$ (approximately 1 inch radius); ii.) outer half-spherical shaped, side wall enclosures 106 span an approximate surface area of 20.0 inches$^2$ (approximately 1.25 inch radius) and approximate volume of 8.18 inches$^3$ (approximately 1.25 inch radius); iii) a pair of oppositionally mounted drivers 116 span an approximate surface area of 2 inches$^2$ (approximately 0.75 inch radius) and approximate thickness of 0.5 inches; iv.) a low frequency driver 112 spans an approximate surface area of 5 inches$^2$ (approximately 1.25 inch radius) and approximate height of 0.5 inches; v.) a crossover network 142 spans an approximate surface area of 1.0 inches$^2$ and an approximate height of 0.50 inches; vii.) a vent cover 138 spans an approximate surface area of 5 inches$^2$ (approximately 1.25 inch radius) and an approximate height of 0.25 inches for the low frequency driver 112; viii) half spherical-shaped bowls 120 not apply (N/A) to this embodiment; viv.) in one embodiment, phase plug 124 occupies an approximate surface area of 0.8 inches$^2$ (approximately 0.5 inch radius) and an approximate height of 0.25 inches, in another embodiment, phase plug 124 occupies an approximate diameter of 23.7 mm and height of flat-bottom teardrop shaped structure 127 of approximately 8.4 mm; vv.) sound port 128 including channel occupies an approximate dimensionality of 1 inches in length, 0.25 inches in width, and 0.25 inches in thickness, in yet another embodiment, channel occupies an approximate area of 83.37 mm and has an approximate length of 66.3 mm.

For example, for a consumer product 101 using system 100 having an approximately 5 inch diameter helmet (e.g., medium helmet) would include the following dimensions:

i.) inner half-spherical shaped, side wall enclosures 104 span an approximate surface area of 50 inches$^2$ (approximately 2 inch radius) and an approximate volume of 34 inches$^3$ (approximately 2 inch radius); ii.) outer half-spherical shaped, side wall enclosures 106 span an approximate surface area of 78 inches$^2$ (approximately 2.50 inch radius) and approximate volume of 65 inches$^3$ (approximately 2.5 inch radius); iii) a pair of oppositionally mounted drivers 116 span an approximate surface area of 7 inches$^2$ (approximately 1.5 inch radius) and approximate thickness of 0.75 inches; iv.) a low frequency driver 112 spans an approximate surface area of 20 inches$^2$ (approximately 2.5 inch radius) and approximate height of 0.75 inches; v.) a crossover network 142 spans an approximate surface area of 1.0 inches$^2$ and an approximate height of 0.50 inches; vii.) a vent cover 138 spans an approximate surface area of 20 inches$^2$ (approximately 2.5 inch radius) and an approximate height of 0.25 inches for the low frequency driver 112; viii) half-spherical shaped bowls 120 not apply (N/A) to this embodiment; viv.) phase plug 124 occupies an approximate surface area of 3 inches$^2$ (approximately 1 inch radius) and an approximate height of 0.25 inches, in another embodiment, phase plug 124 occupies an approximate diameter of 38 mm and height of a flat-bottomed teardrop shaped structure 127 of approximately 15.7 mm; vv.) sound port 128 including channel occupies an approximate dimensionality of 1 inches in length, 0.25 inches in width, and 0.25 inches in thickness, in yet another embodiment, channel occupies an approximate area of 191.4 mm and has an approximate length of 109.5 mm.

For example, for a consumer product 101 using system 100 having an approximately 10 inch diameter helmet (e.g., large helmet) would include the following dimensions:

i.) inner half-spherical shaped, side wall enclosures 104 span an approximate surface area of 200 inches$^2$ (approximately 4 inch radius) and an approximate volume of 268 inches$^3$ (approximately 4 inch radius); ii.) outer half-spherical shaped, side wall enclosures 106 span an approximate surface area of 314 inches$^2$ (approximately 5 inch radius) and approximate volume of 525 inches$^3$ (approximately 5 inch radius); iii) a pair of oppositionally mounted drivers 116 span an approximate surface area of 28 inches$^2$ (approximately 3 inch radius) and approximate thickness of 0.5 inches; iv.) a low frequency driver 112 spans an approximate surface area of 78 inches$^2$ (approximately 5 inch radius) and approximate height of 1.0 inches; v.) a crossover network 142 spans an approximate surface area of 1.0 inches$^2$ and an approximate height of 0.50 inches; vii.) a vent cover 138 spans an approximate surface area of 78 inches$^2$ (approximately 5 inch radius) and an approximate height of 0.25 inches for the low frequency driver 112; viii) half-spherical shaped bowls 120 spans an approximate surface area 60 inches$^2$ (approximately 3 inch radius) and an approximate volume of 60 inches$^3$ (approximately 3 inch radius), in yet another embodiment, half-spherical shaped bowls 120 have an approximate outer diameter of 50 mms and from back side of oppositionally mounted drivers 116 a width transition section from diameter of drivers 116 back to the diameter of 50 mms in an approximately 16.5 mm horizontal direction; viv.) phase plug 124 occupies an approximate surface area of 0.8 inches$^2$ (approximately 0.5 inch radius) and an approximate height of 0.25 inches, in yet another embodiment, phase plug 124 occupies an approximate diameter of 44 mm and height of flat-bottomed teardrop shaped structure 127 of approximately 16.9 mm; vv.) sound port 128 including channel occupies an approximate dimensionality of 1 inches in length, 0.25 inches in width, and 0.25 inches in thickness, in yet another embodiment, channel occupies an approximate area of 567.2 mm and has an approximate length of 126.6 mm.

Figure 2:
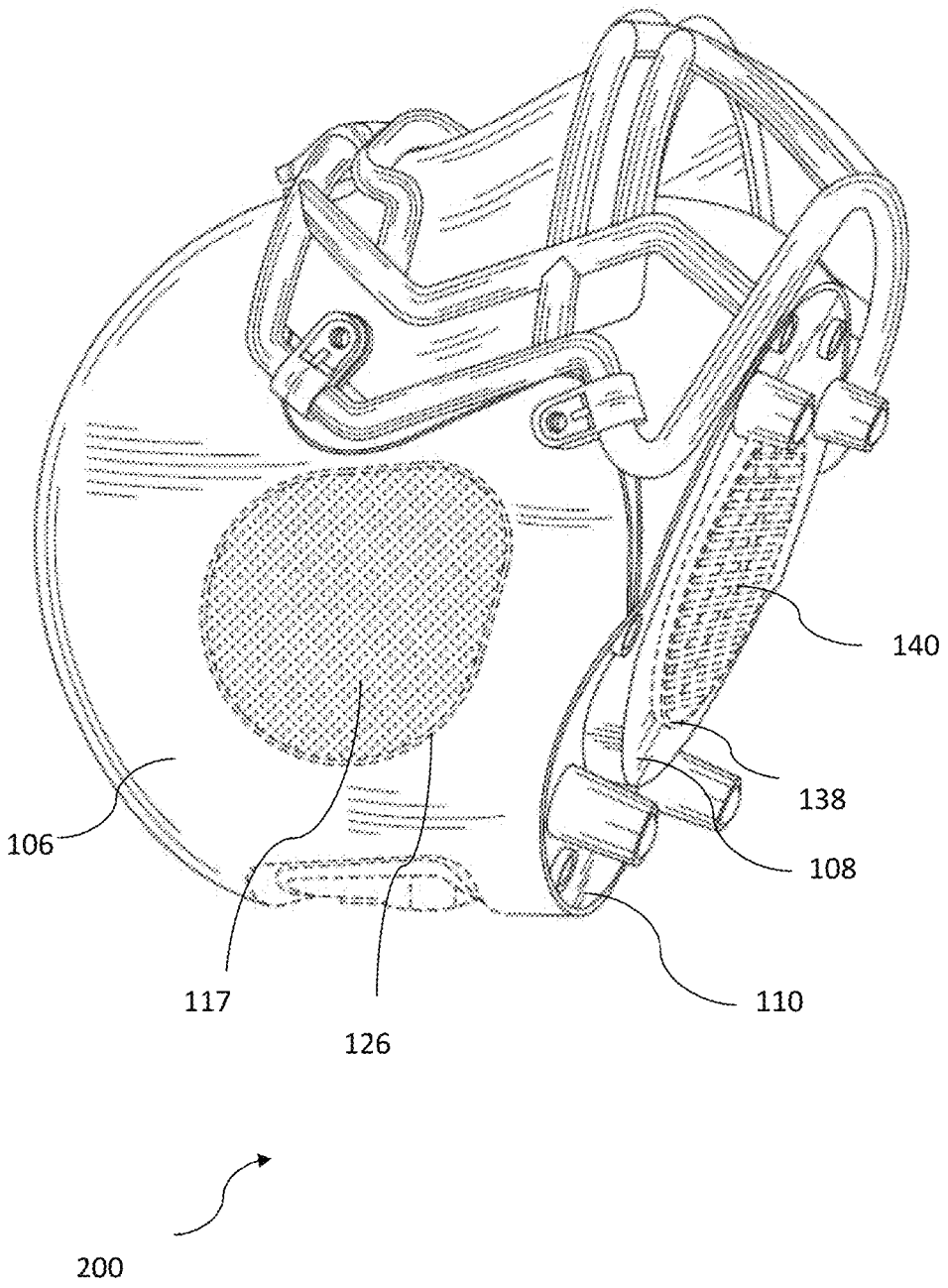
FIG. 2 is a left side, elevated perspective view 200 illustrates a consumer product 101 using the Improved 360 Degree Surround Sound Portable Speaker System 100 according to an embodiment of the present disclosure of FIG. 1.

FIG. 2 is a left side, elevated perspective view 200 illustrates a consumer product 101 using the Improved 360 Degree Surround Sound Portable Speaker System 100 according to an embodiment of the present disclosure of FIG. 1.

Figure 3:
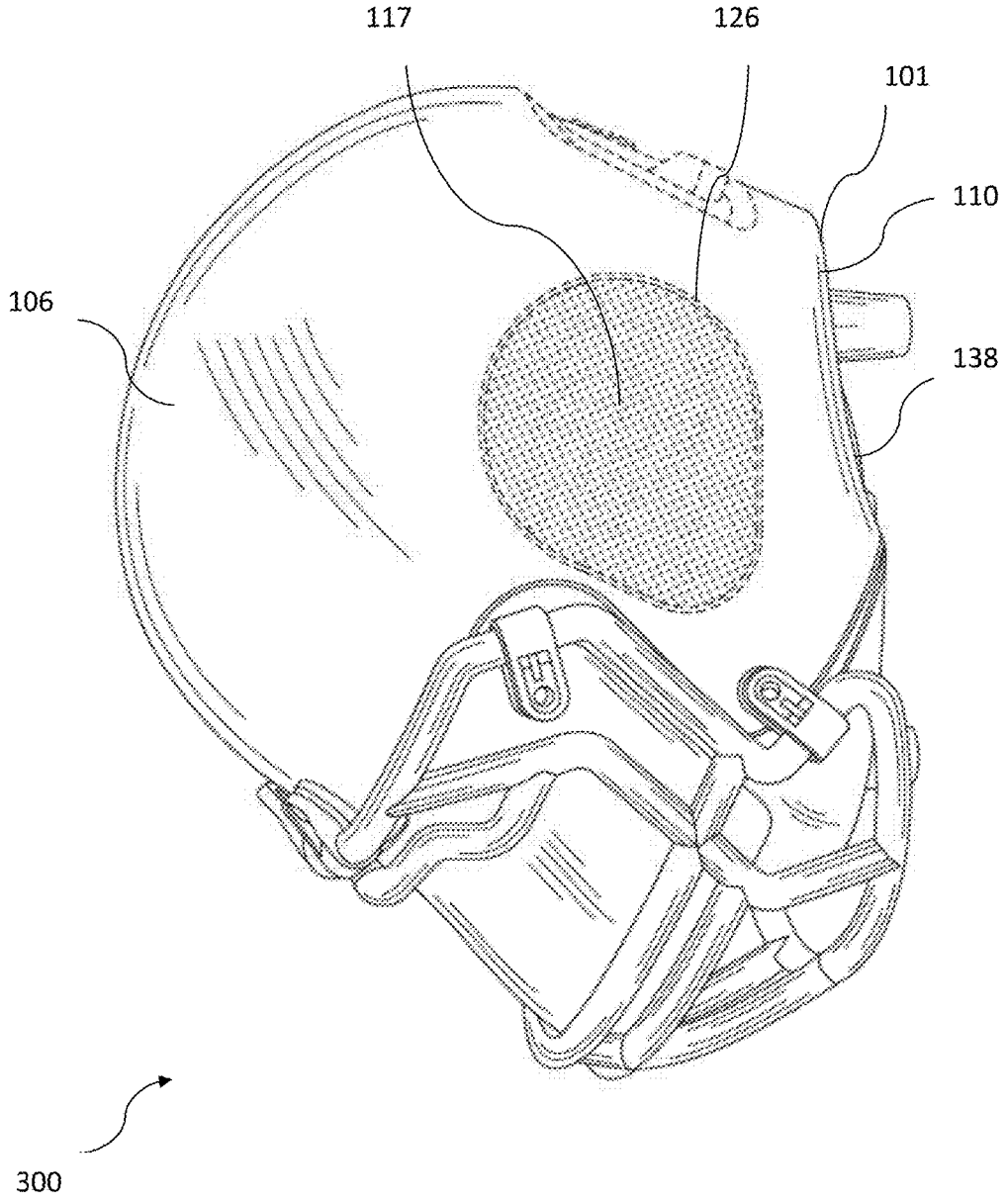
FIG. 3 is a right side, elevated perspective view 300 that illustrates a consumer product 101 of Improved 360 Degree Surround Sound Portable Speaker System of FIG. 2 according to an embodiment of the present disclosure of FIG. 1.

FIG. 3 is a right side, elevated perspective view 300 that illustrates a consumer product 101 of Improved 360 Degree Surround Sound Portable Speaker System of FIG. 2 according to an embodiment of the present disclosure of FIG. 1.

Figure 4:
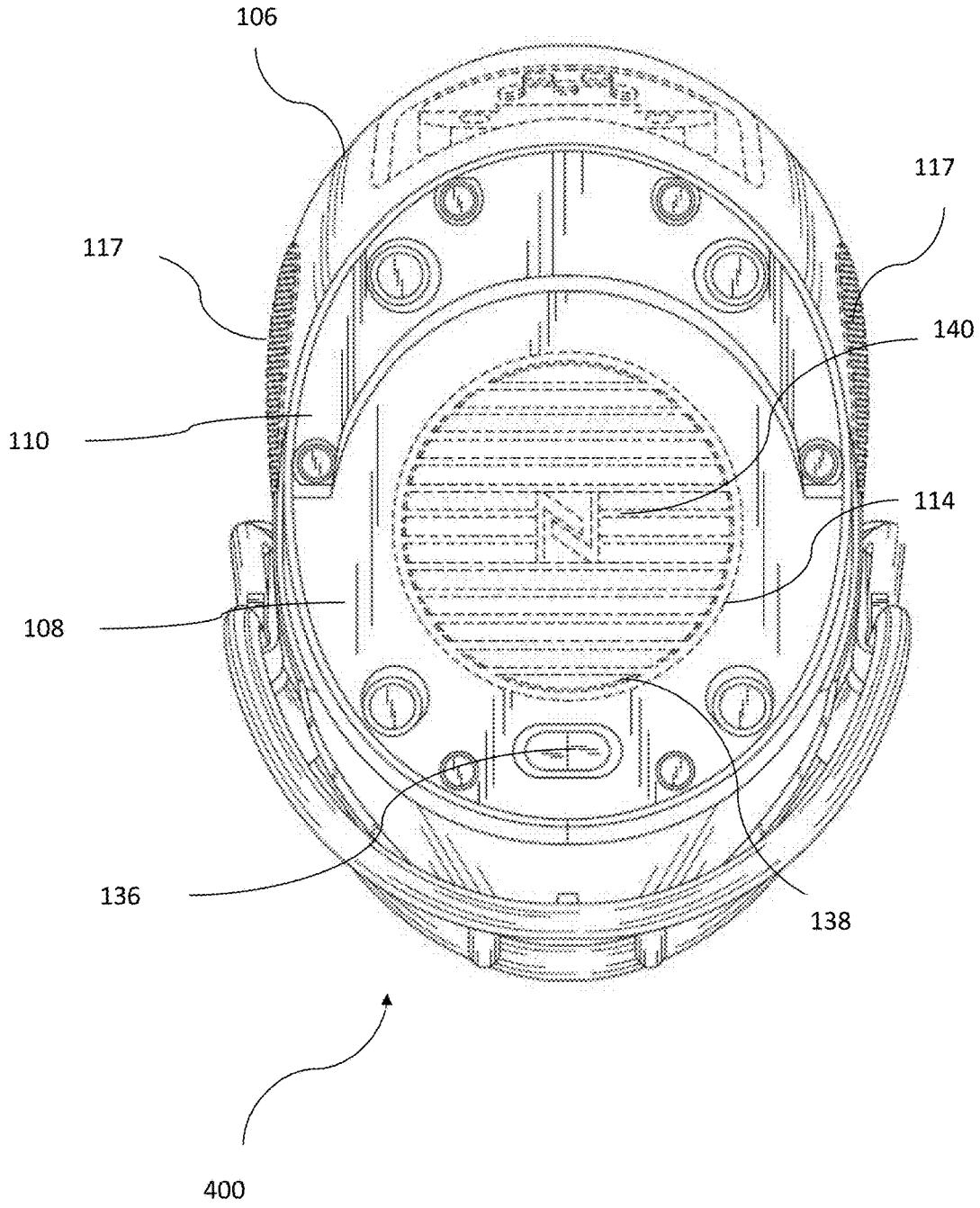
FIG. 4 is a bottom view 400 illustrating the low frequency driver 112 and elevated horizontal base region 110 of a consumer product 101 for Improved 360 Degree Surround Sound Portable Speaker System 100 of FIG. 2 according to an embodiment of the present disclosure of FIG. 1.

FIG. 4 is a bottom view 400 illustrating the low frequency driver 112 and elevated horizontal base region 110 of a consumer product 101 for Improved 360 Degree Surround Sound Portable Speaker System 100 of FIG. 2 according to an embodiment of the present disclosure of FIG. 1.

Figure 5:
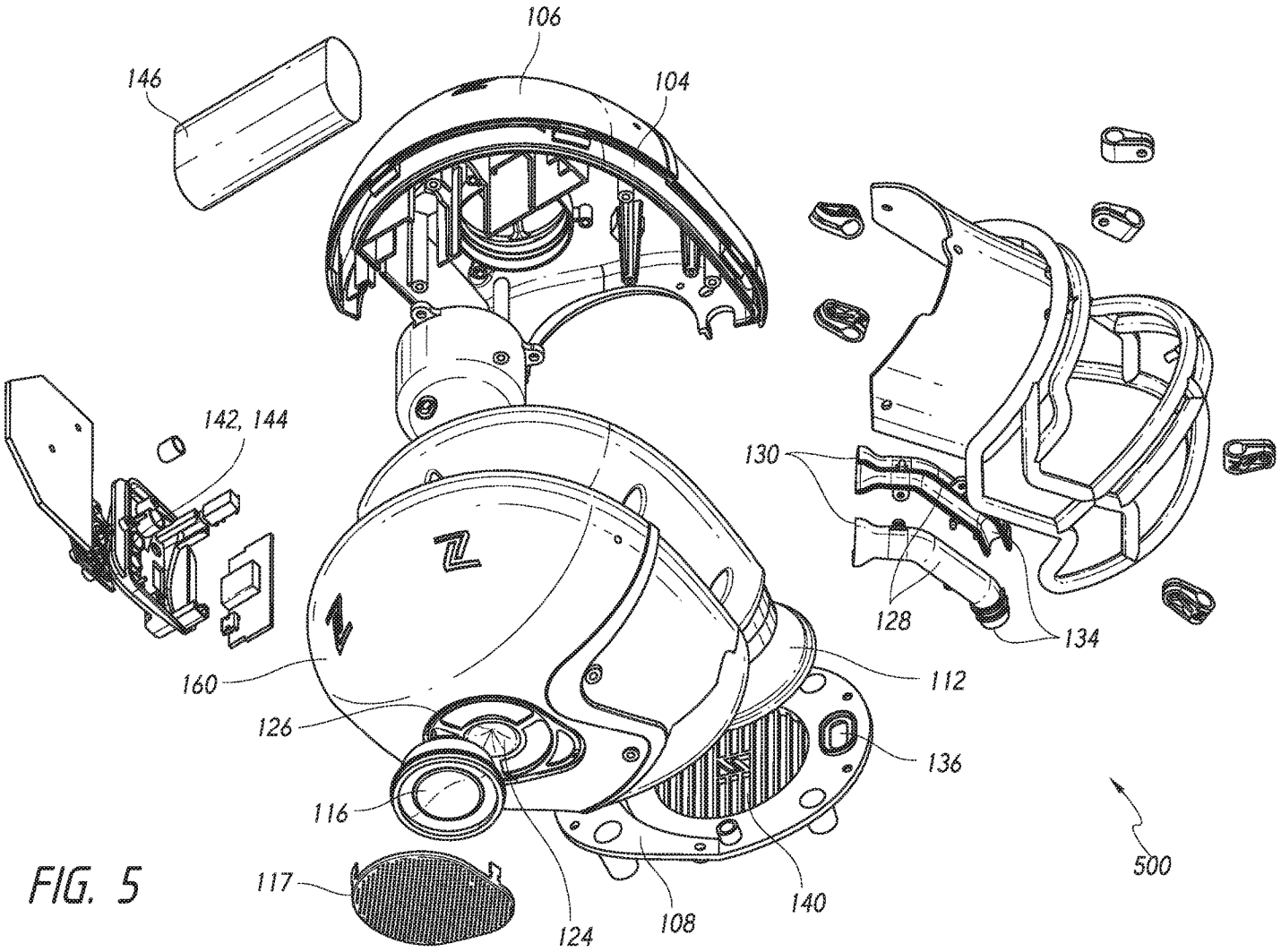
FIG. 5 is a partial exploded view 500 illustrating right a consumer product 101 for Improved 360 Degree Surround Sound Portable Speaker System 100 of FIG. 2 according to an embodiment of the present disclosure of FIG. 1.

FIG. 5 is a partial exploded view 500 illustrating right a consumer product 101 for Improved 360 Degree Surround Sound Portable Speaker System 100 of FIG. 2 according to an embodiment of the present disclosure of FIG. 1.

Figure 6:
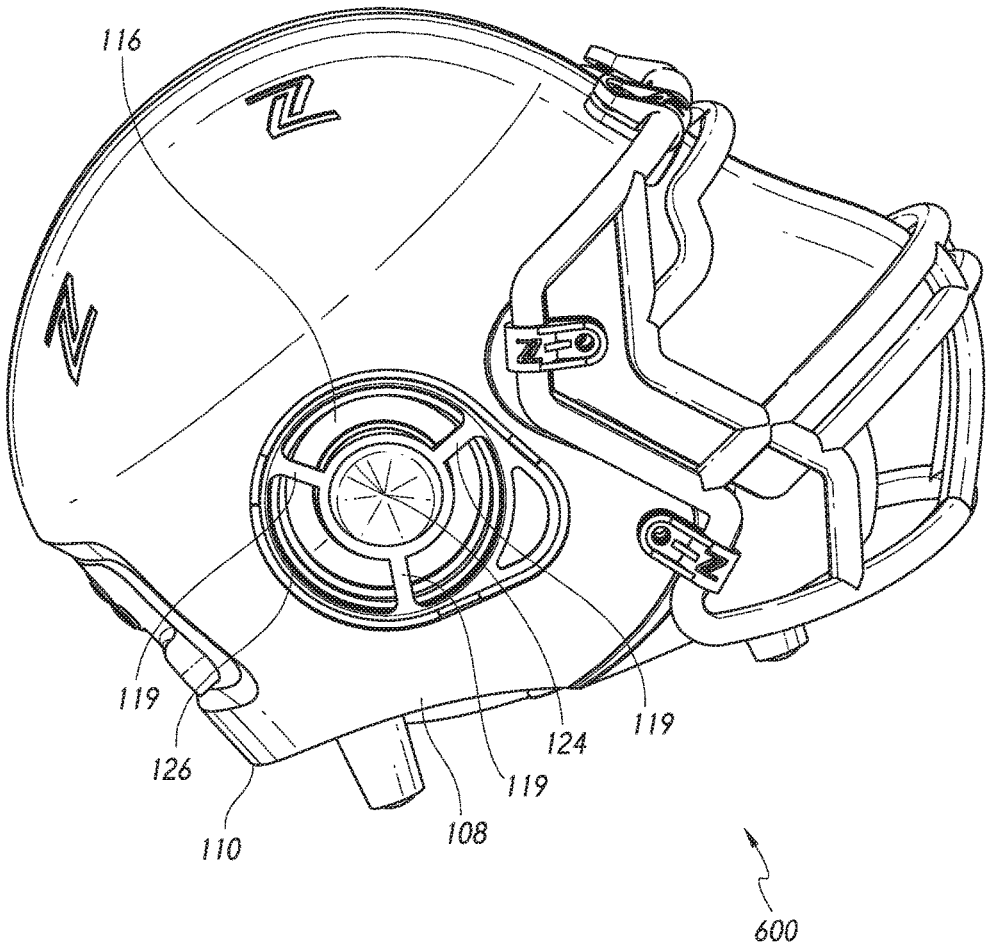
FIG. 6 is a side view 600 with mesh 117 removed illustrating one of a pair of oppositionally mounted drivers 116 and selected adjacent components and features of a consumer product 101 for Improved 360 Degree Surround Sound Portable Speaker System 100 of FIG. 2 according to an embodiment of the present disclosure of FIG. 1.

FIG. 6 is a side view 600 with mesh 117 removed illustrating one of a pair of oppositionally mounted drivers 116 and selected adjacent components and features of a consumer product 101 for Improved 360 Degree Surround Sound Portable Speaker System 100 of FIG. 2 according to an embodiment of the present disclosure of FIG. 1.

Figure 7:
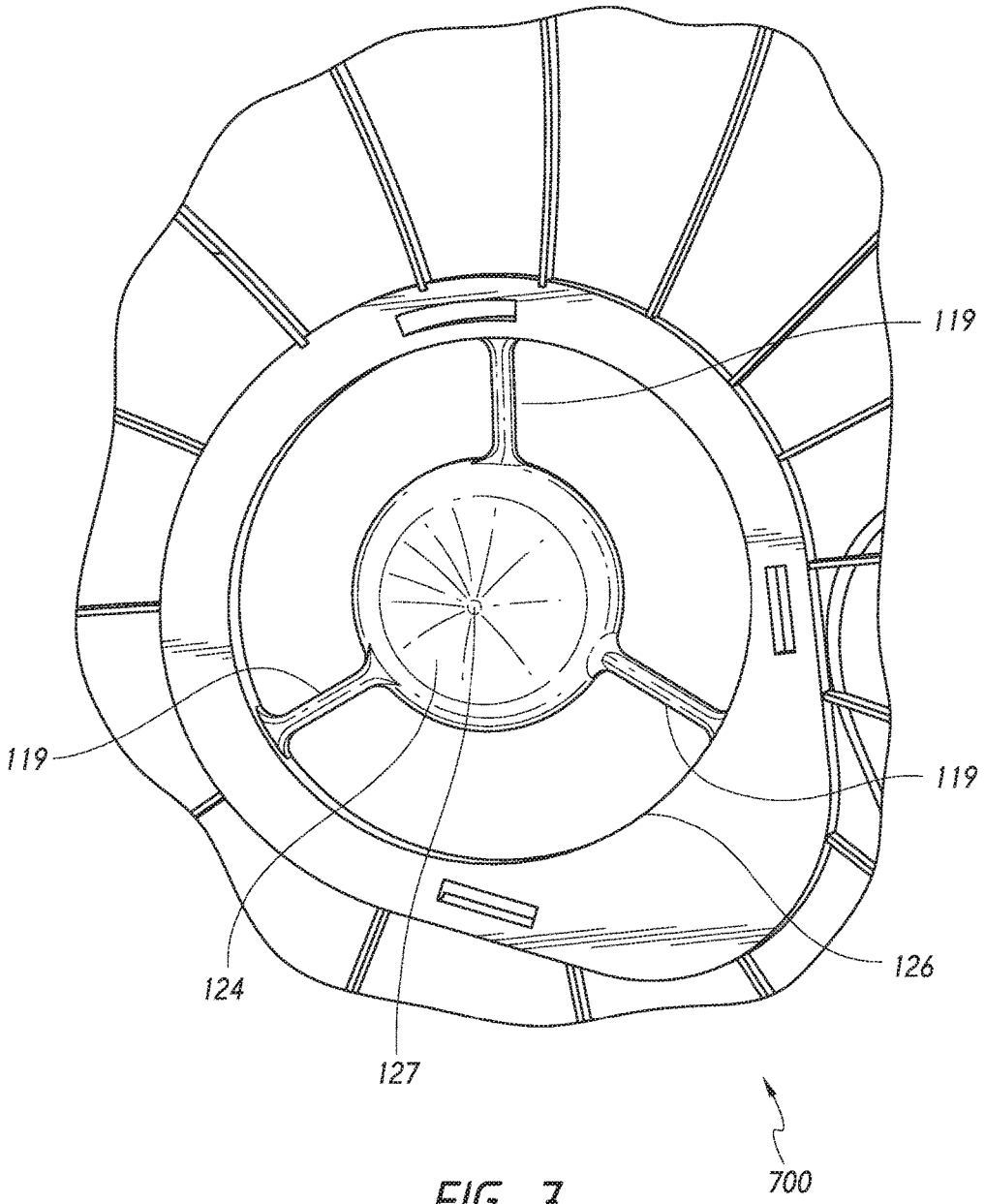
FIG. 7 is a back view 700 illustrating a phase plug 124 having on a back side a flat-bottom teardrop shaped structure 127 on an inner side, e.g., back side, utilized for the pair of oppositionally mounted drivers 116 of a consumer product 101 for Improved 360 Degree Surround Sound Portable Speaker System 100 of FIG. 2 according to an embodiment of the present disclosure of FIG. 1.

FIG. 7 is a back view 700 illustrating a phase plug 124 having on a back side a flat-bottom teardrop shaped structure 127 on an inner side, e.g., back side, utilized for the pair of oppositionally mounted drivers 116 of a consumer product 101 for Improved 360 Degree Surround Sound Portable Speaker System 100 of FIG. 2 according to an embodiment of the present disclosure of FIG. 1.

Figure 8:
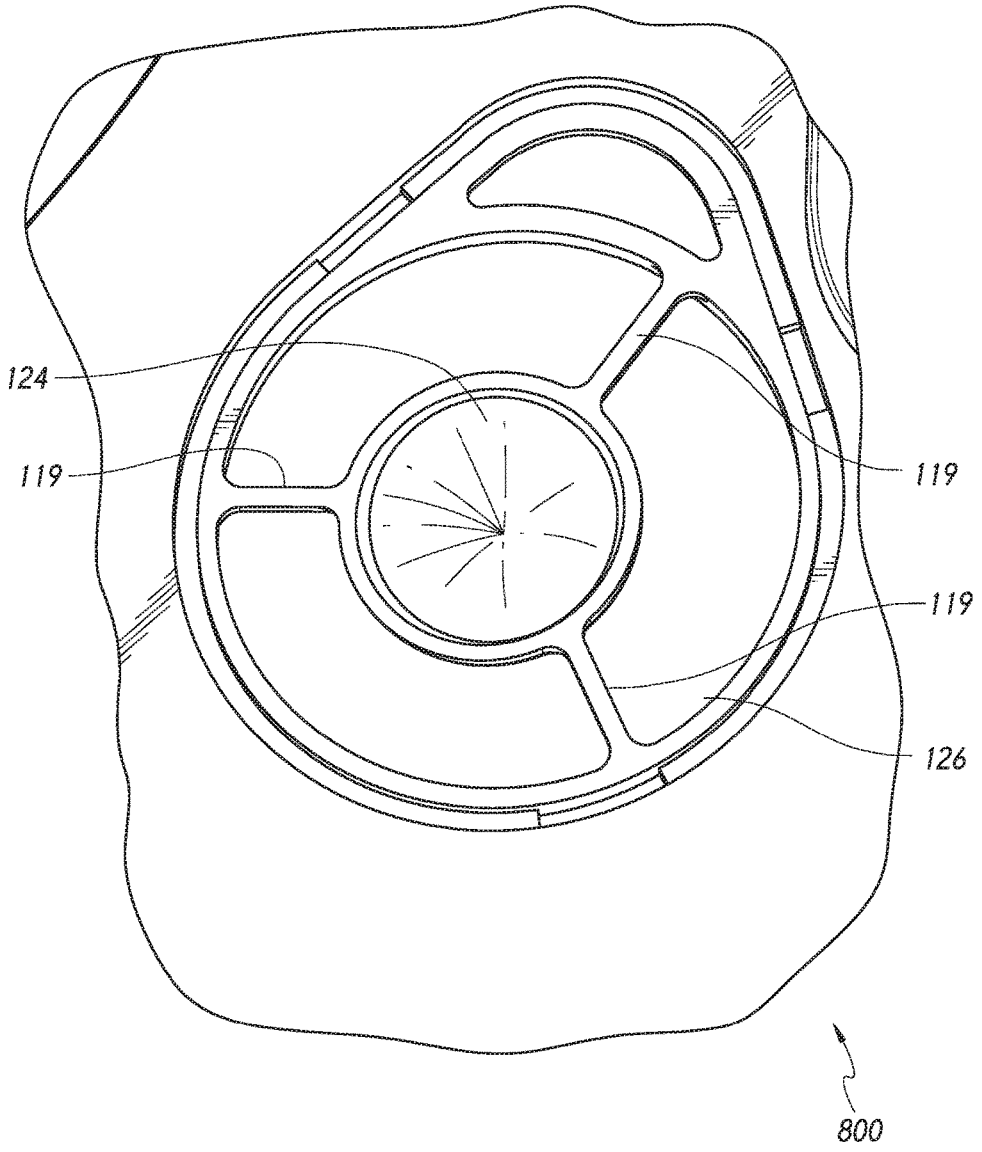
FIG. 8 is a front view 800 illustrating a phase plug 124 having on a back side a flat-bottom teardrop shaped structure 127 on an inner side, e.g., back side (as illustrated in FIG. 7) utilized for the pair of oppositionally mounted drivers 116 of a consumer product 101 for Improved 360 Degree Surround Sound Portable Speaker System 100 of FIG. 2 according to an embodiment of the present disclosure of FIG. 1.

FIG. 8 is a front view 800 illustrating a phase plug 124 having on a back side a flat-bottom teardrop shaped structure 127 on an inner side, e.g., back side (as illustrated in FIG. 7) utilized for the pair of oppositionally mounted drivers 116 of a consumer product 101 for Improved 360 Degree Surround Sound Portable Speaker System 100 of FIG. 2 according to an embodiment of the present disclosure of FIG. 1.

Figure 9:
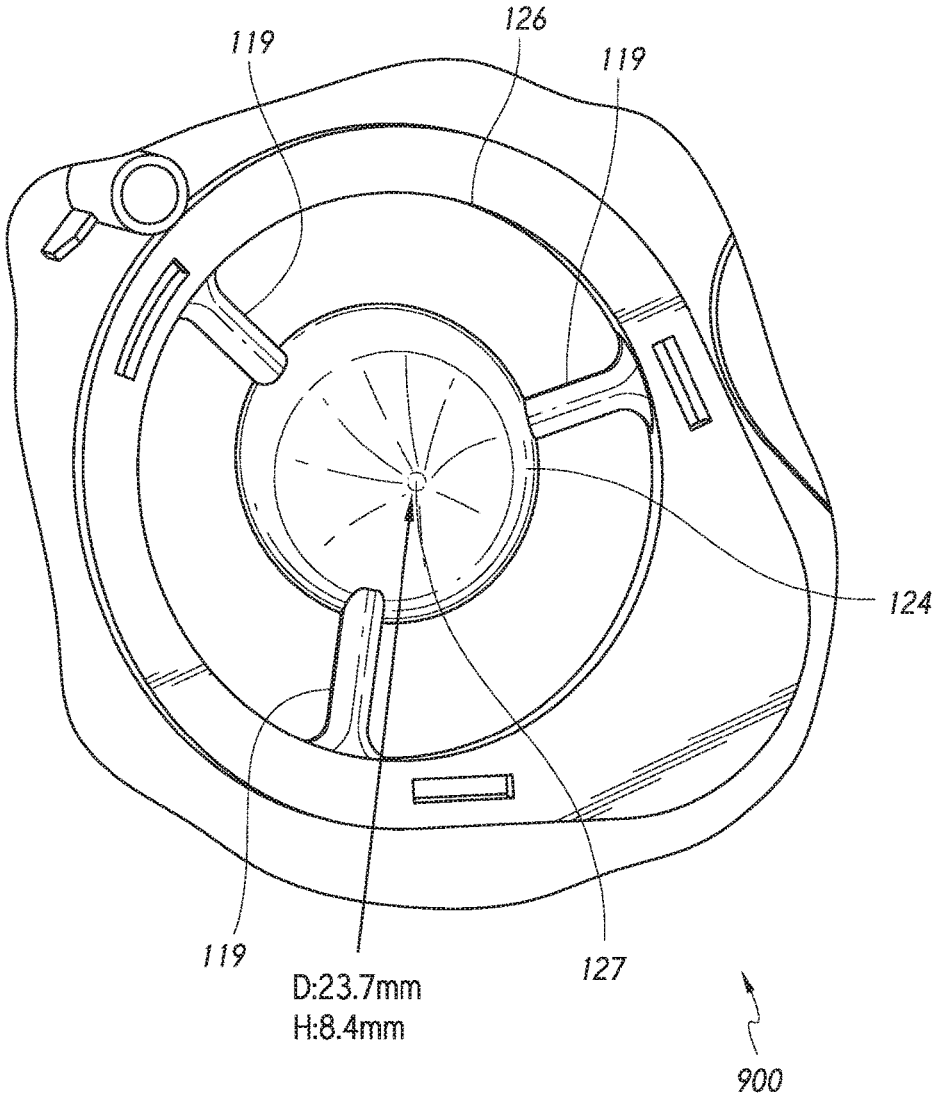
FIG. 9 is a back view 900 illustrating a phase plug 124 including diameter 23.7 mm having on a back side a flat-bottom teardrop shaped structure 127 with height 8.44 mm on an inner side, e.g., back side, utilized for the pair of oppositionally mounted drivers 116 of a consumer product 101 for Improved 360 Degree Surround Sound Portable Speaker System 100 of FIG. 2 according to an embodiment of the present disclosure of FIG. 1.

FIG. 9 is a back view 900 illustrating a phase plug 124 including diameter 23.7 mm having on a back side a flat-bottom teardrop shaped structure 127 with height 8.44 mm on an inner side, e.g., back side, utilized for the pair of oppositionally mounted drivers 116 of a consumer product 101 for Improved 360 Degree Surround Sound Portable Speaker System 100 of FIG. 2 according to an embodiment of the present disclosure of FIG. 1.

Figure 10:
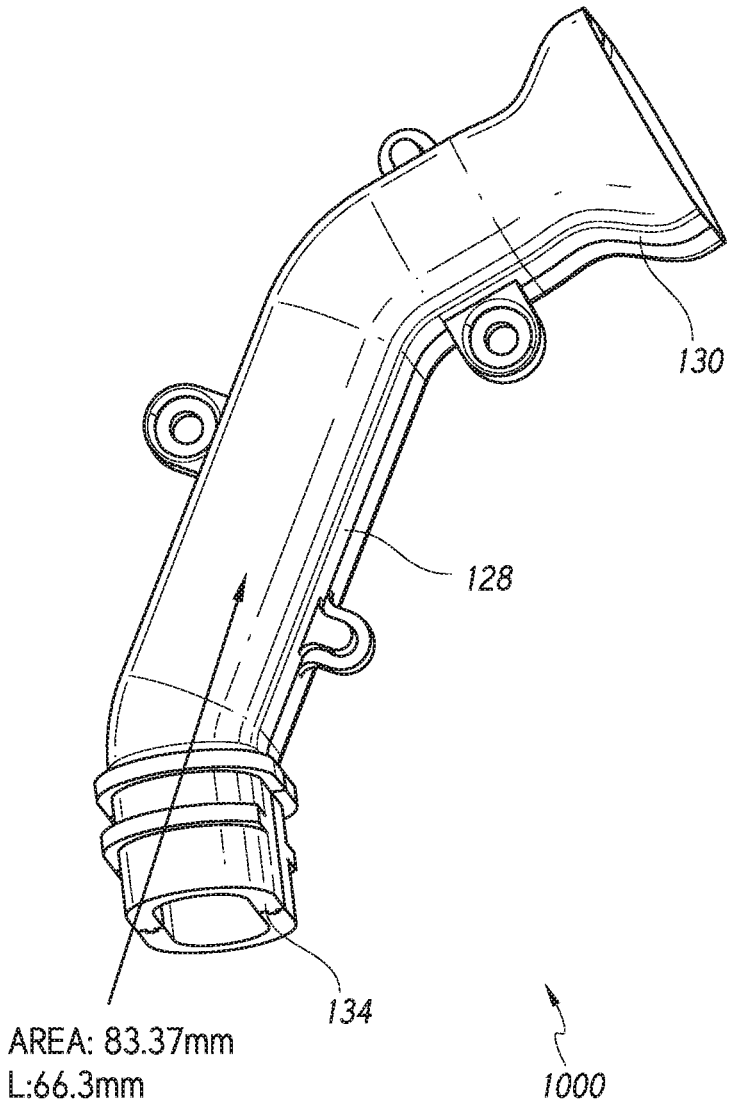
FIG. 10 is a front view 1000 illustrating a sound port 128 having area of 83.37 mm and length equals 66.3 mm utilized for sound port opening 136 and low frequency driver 112 of a consumer product 101 for Improved 360 Degree Surround Sound Portable Speaker System 100 of FIG. 2 according to an embodiment of the present disclosure of FIG. 1.

FIG. 10 is a front view 1000 illustrating a sound port 128 having area of 83.37 mm and length equals 66.3 mm utilized for sound port opening 136 and low frequency driver 112 of a consumer product 101 for Improved 360 Degree Surround Sound Portable Speaker System 100 of FIG. 2 according to an embodiment of the present disclosure of FIG. 1.

Figure 11:
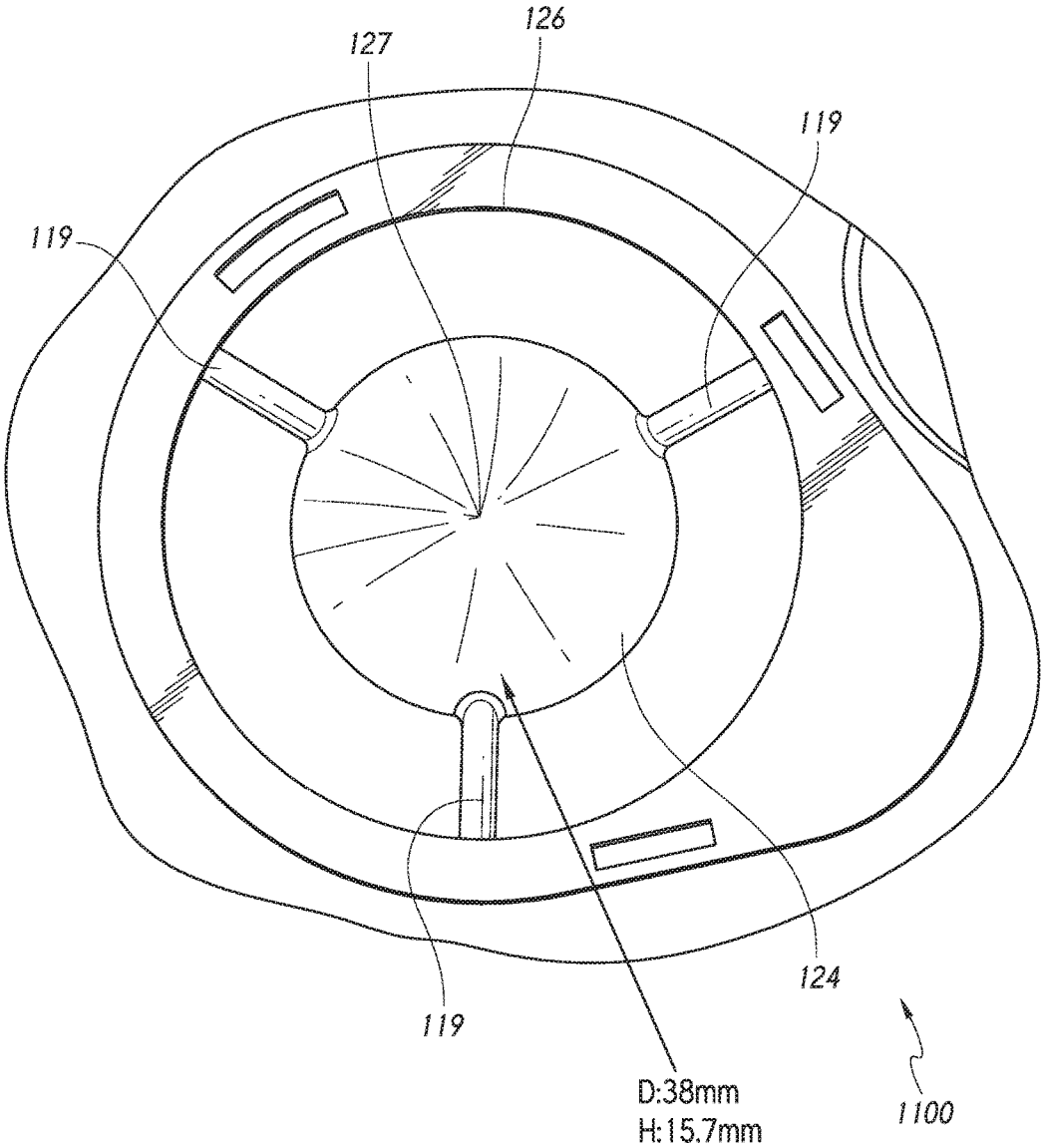
FIG. 11 is a back view 1100 illustrating a phase plug 124 including diameter 38 mm having on a back side a flat-bottom teardrop shaped structure 127 with height 15.7 mm on an inner side, e.g., back side, utilized for the pair of oppositionally mounted drivers 116 of a consumer product 101 for Improved 360 Degree Surround Sound Portable Speaker System 100 of FIG. 2 according to an embodiment of the present disclosure of FIG. 1.

FIG. 11 is a back view 1100 illustrating a phase plug 124 including diameter 38 mm having on a back side a flat-bottom teardrop shaped structure 127 with height 15.7 mm on an inner side, e.g., back side, utilized for the pair of oppositionally mounted drivers 116 of a consumer product 101 for Improved 360 Degree Surround Sound Portable Speaker System 100 of FIG. 2 according to an embodiment of the present disclosure of FIG. 1.

Figure 12:
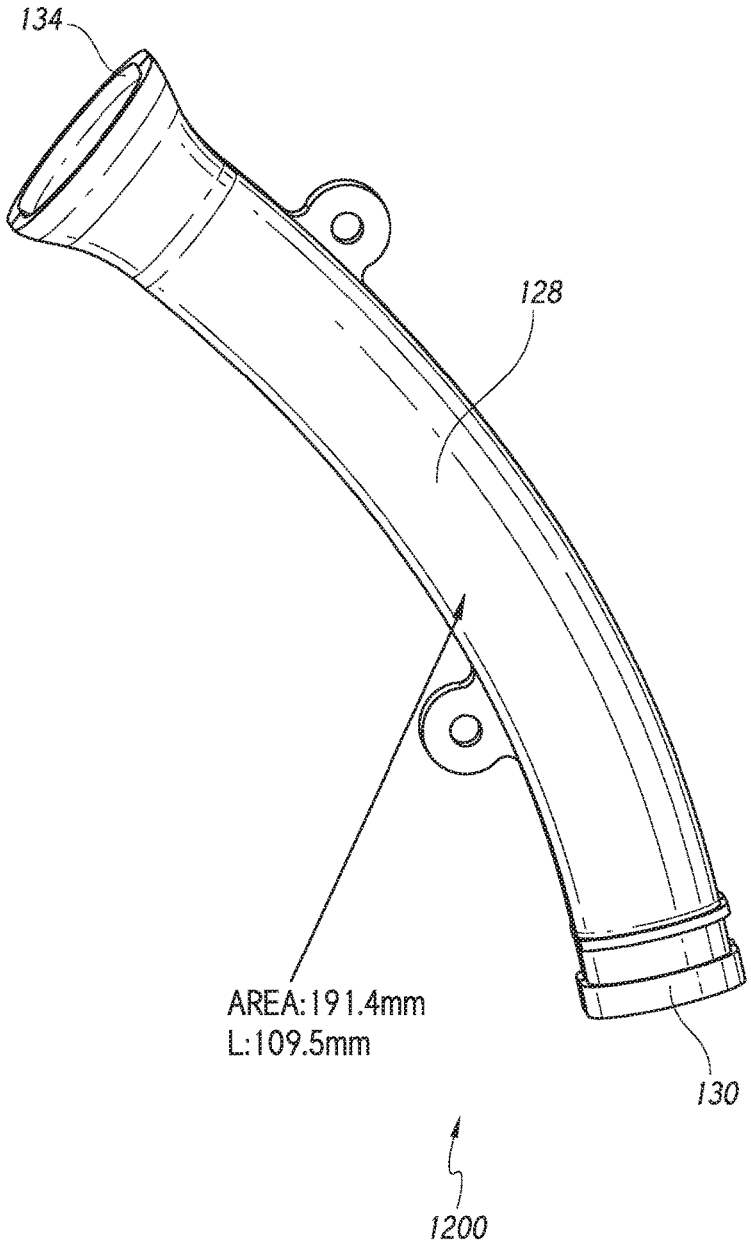
FIG. 12 is a front view 1000 illustrating a sound port 128 having area of 191.4 mm and length equals 109.5 mm utilized for sound port opening 136 and low frequency driver 112 of a consumer product 101 for Improved 360 Degree Surround Sound Portable Speaker System 100 of FIG. 2 according to an embodiment of the present disclosure of FIG. 1.

FIG. 12 is a front view 1000 illustrating a sound port 128 having area of 191.4 mm and length equals 109.5 mm utilized for sound port opening 136 and low frequency driver 112 of a consumer product 101 for Improved 360 Degree Surround Sound Portable Speaker System 100 of FIG. 2 according to an embodiment of the present disclosure of FIG. 1.

Figure 13:
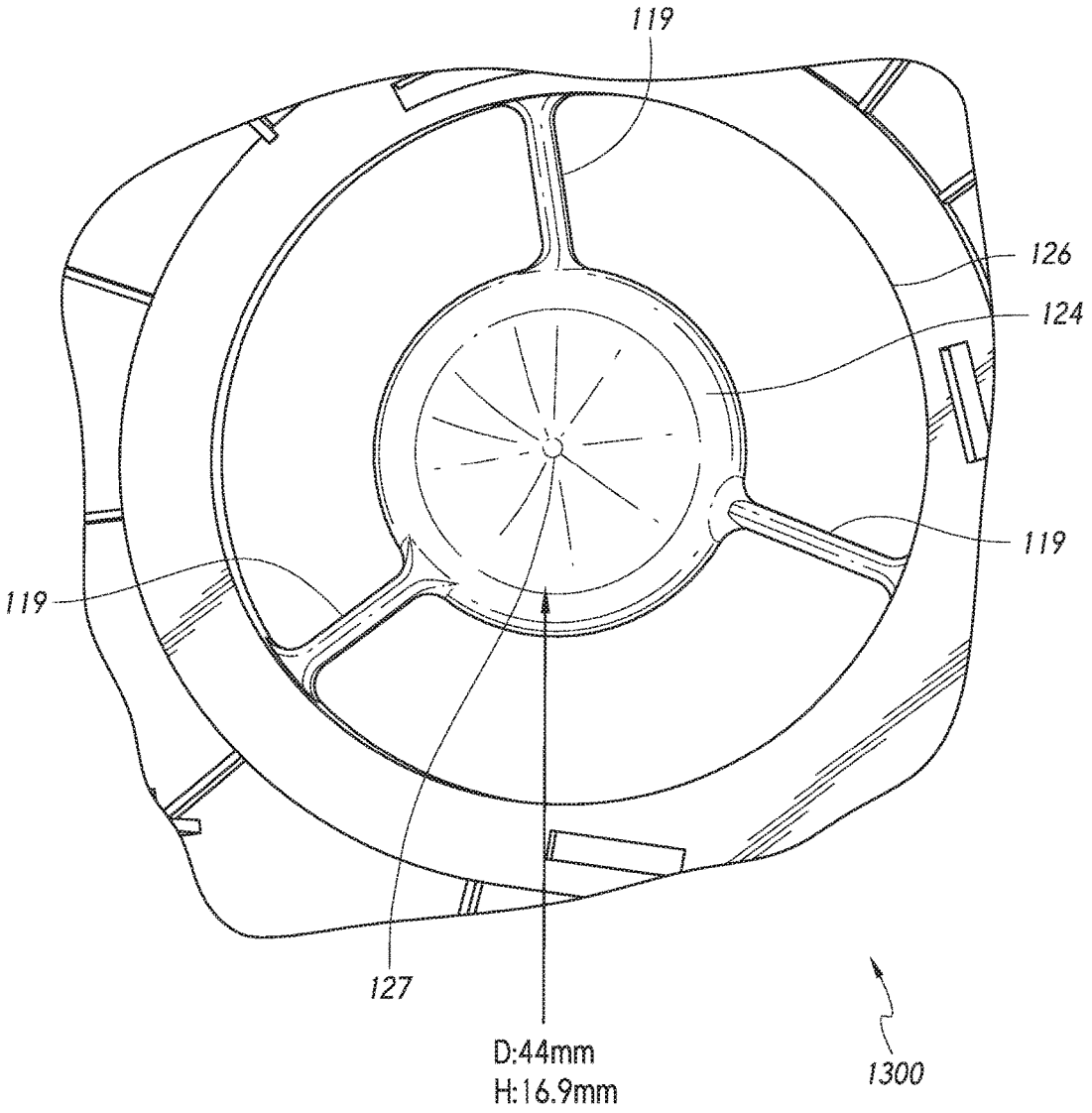
FIG. 13 is a back view 900 illustrating a phase plug 124 including diameter 44 mm having on a back side a flat-bottom teardrop shaped structure 127 with height 16.99 mm on an inner side, e.g., back side, utilized for the pair of oppositionally mounted drivers 116 of a consumer product 101 for Improved 360 Degree Surround Sound Portable Speaker System 100 of FIG. 2 according to an embodiment of the present disclosure of FIG. 1.

FIG. 13 is a back view 900 illustrating a phase plug 124 including diameter 44 mm having on a back side a flat-bottom teardrop shaped structure 127 with height 16.99 mm on an inner side, e.g., back side, utilized for the pair of oppositionally mounted drivers 116 of a consumer product 101 for Improved 360 Degree Surround Sound Portable Speaker System 100 of FIG. 2 according to an embodiment of the present disclosure of FIG. 1.

Figure 14:
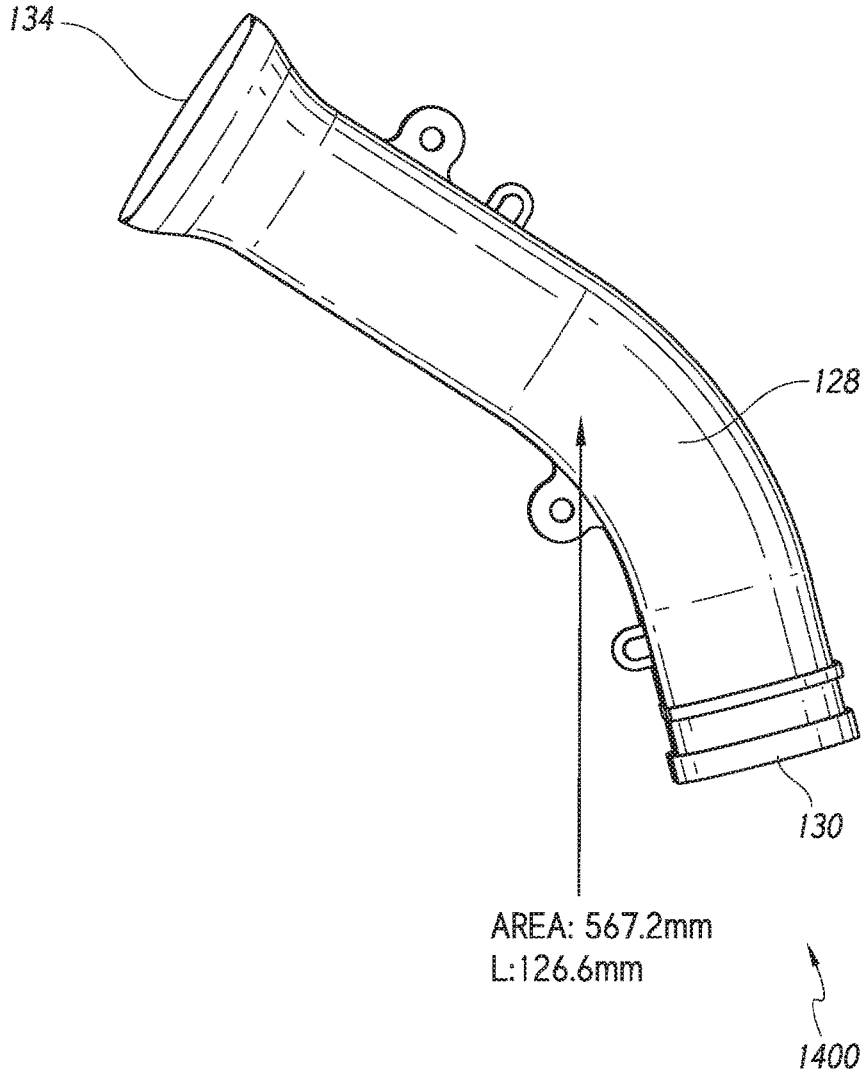
FIG. 14 is a front view 1000 illustrating a sound port 128 having area of 567.22 mm and length equals 126.66 mm utilized for sound port opening 136 and low frequency driver 112 of a consumer product 101 for Improved 360 Degree Surround Sound Portable Speaker System 100 of FIG. 2 according to an embodiment of the present disclosure of FIG. 1.

FIG. 14 is a front view 1000 illustrating a sound port 128 having area of 567.22 mm and length equals 126.66 mm utilized for sound port opening 136 and low frequency driver 112 of a consumer product 101 for Improved 360 Degree Surround Sound Portable Speaker System 100 of FIG. 2 according to an embodiment of the present disclosure of FIG. 1.

Figure 15:
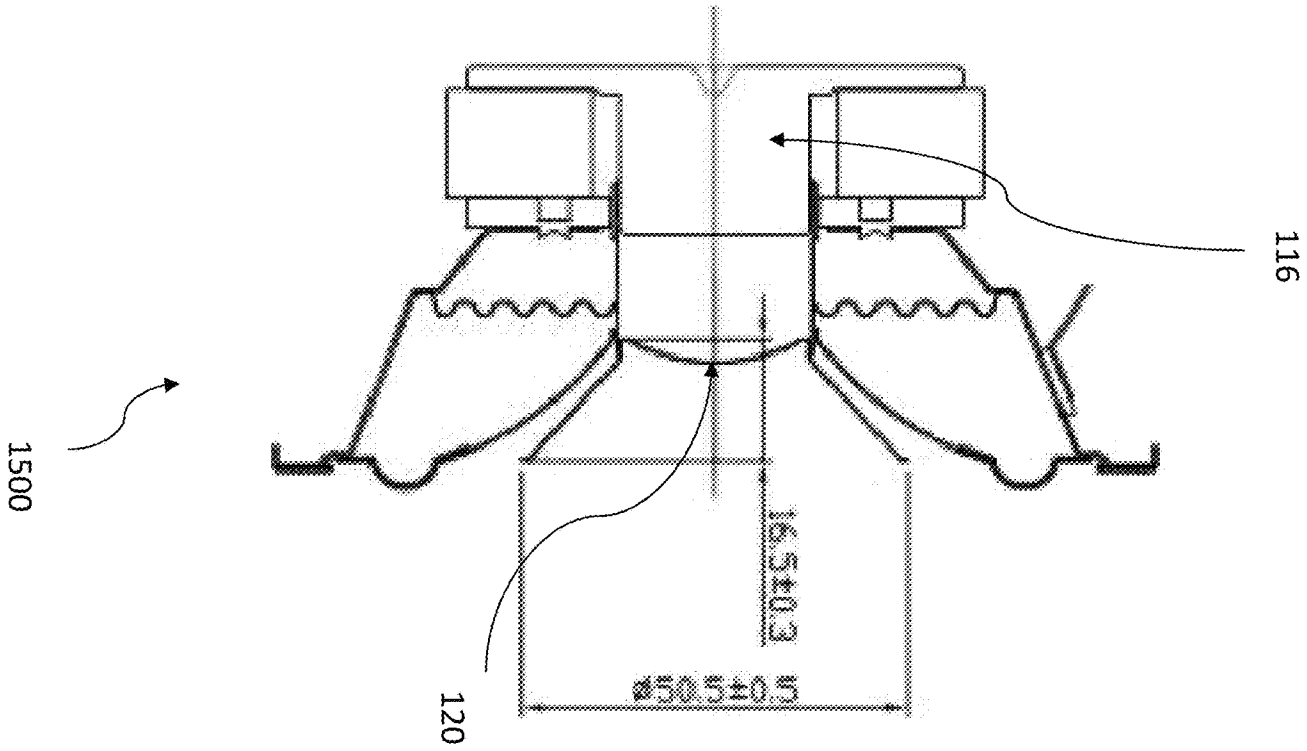
FIG. 15 is a cutaway, side view 1500 illustrating a half-spherical shaped bowl 120 utilized for the pair of oppositionally mounted drivers 116 of a consumer product 101 for Improved 360 Degree Surround Sound Portable Speaker System 100 of FIG. 2 according to an embodiment of the present disclosure of FIG. 1.

FIG. 15 is a cutaway, side view 1500 illustrating a half-spherical shaped bowl 120 utilized for the pair of oppositionally mounted drivers 116 of a consumer product 101 for Improved 360 Degree Surround Sound Portable Speaker System 100 of FIG. 2 according to an embodiment of the present disclosure of FIG. 1.

Figure 16:
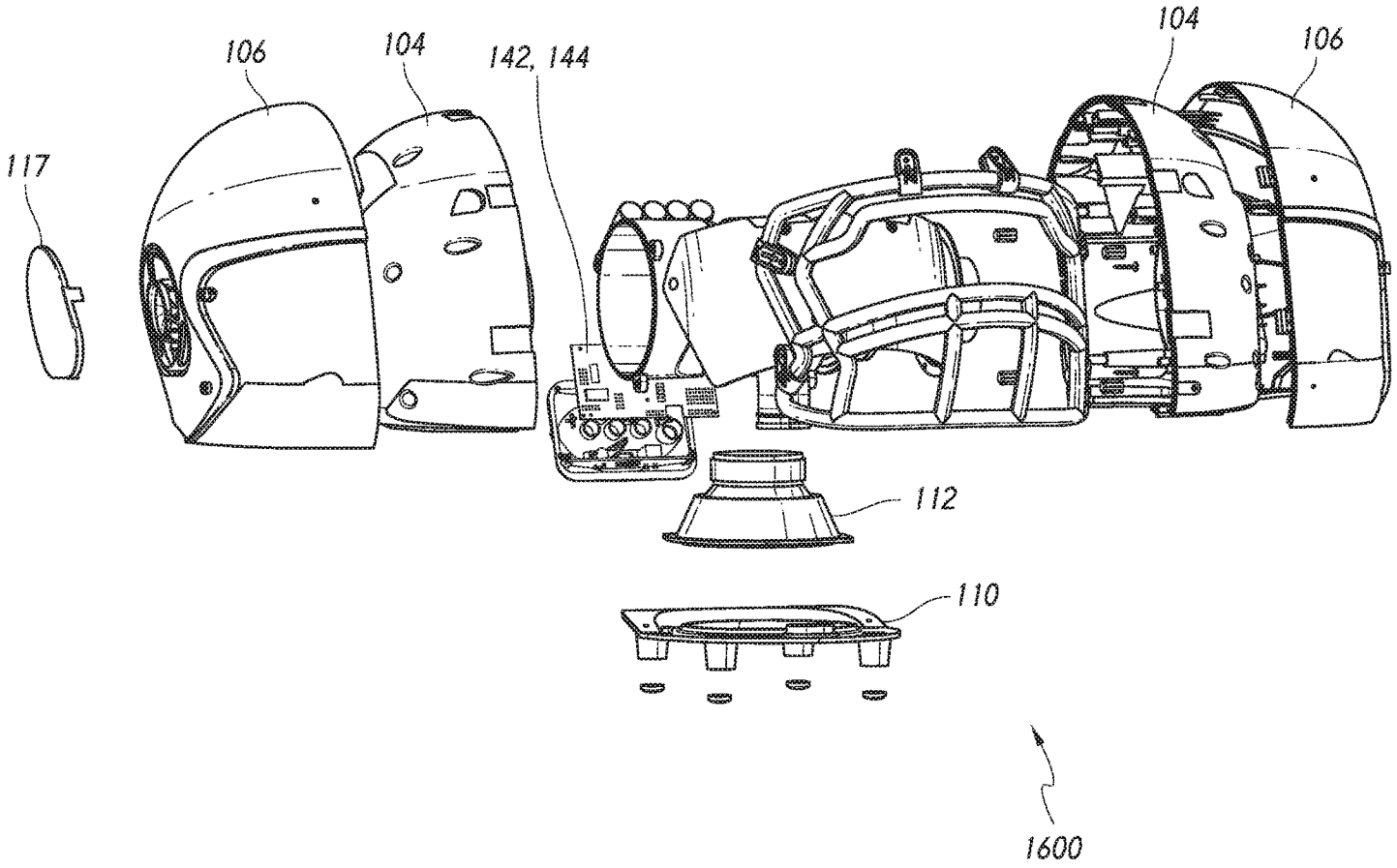
FIG. 16 is a partially exploded, front view 1600 illustrating inner and outer half-spherical shaped, side wall enclosures 104, 106 and elevated horizontal base region 110 of a consumer product 101 for Improved 360 Degree Surround Sound Portable Speaker System 100 of FIG. 2 according to an embodiment of the present disclosure of FIG. 1.

FIG. 16 is a partially exploded, front view 1600 illustrating inner and outer half-spherical shaped, side wall enclosures 104, 106 and elevated horizontal base region 110 of a consumer product 101 for Improved 360 Degree Surround Sound Portable Speaker System 100 of FIG. 2 according to an embodiment of the present disclosure of FIG. 1.

Figure 17:
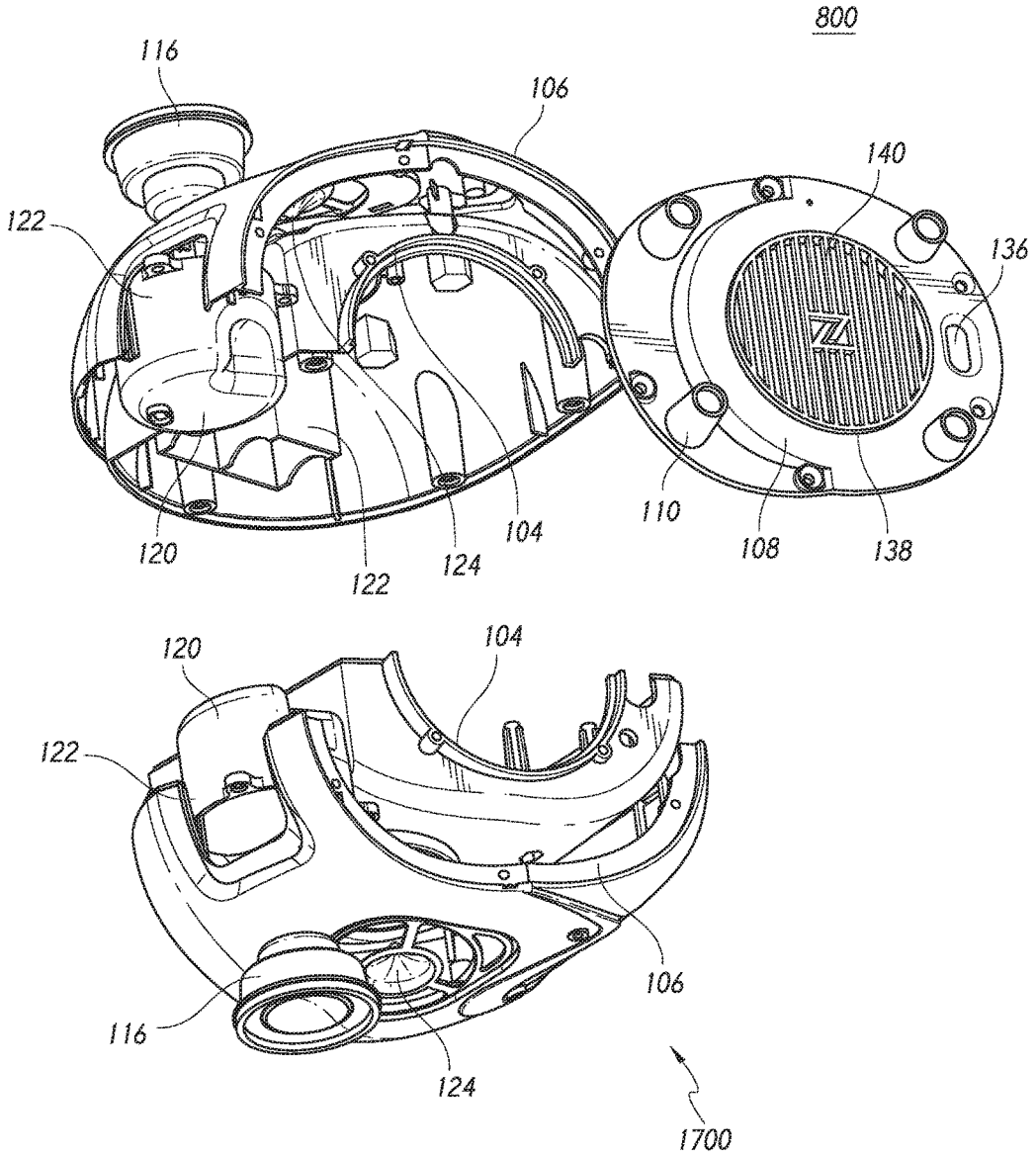
FIG. 17 is a partially exploded, side view 1700 illustrating inner and outer half-spherical shaped, side wall enclosures 104, 106 and elevated horizontal base region 110 of a consumer product 101 for Improved 360 Degree Surround Sound Portable Speaker System 100 of FIG. 2 according to an embodiment of the present disclosure of FIG. 1.

FIG. 17 is a partially exploded, side view 1700 illustrating inner and outer half-spherical shaped, side wall enclosures 104, 106 and elevated horizontal base region 110 of a consumer product 101 for Improved 360 Degree Surround Sound Portable Speaker System 100 of FIG. 2 according to an embodiment of the present disclosure of FIG. 1.

Figure 18:
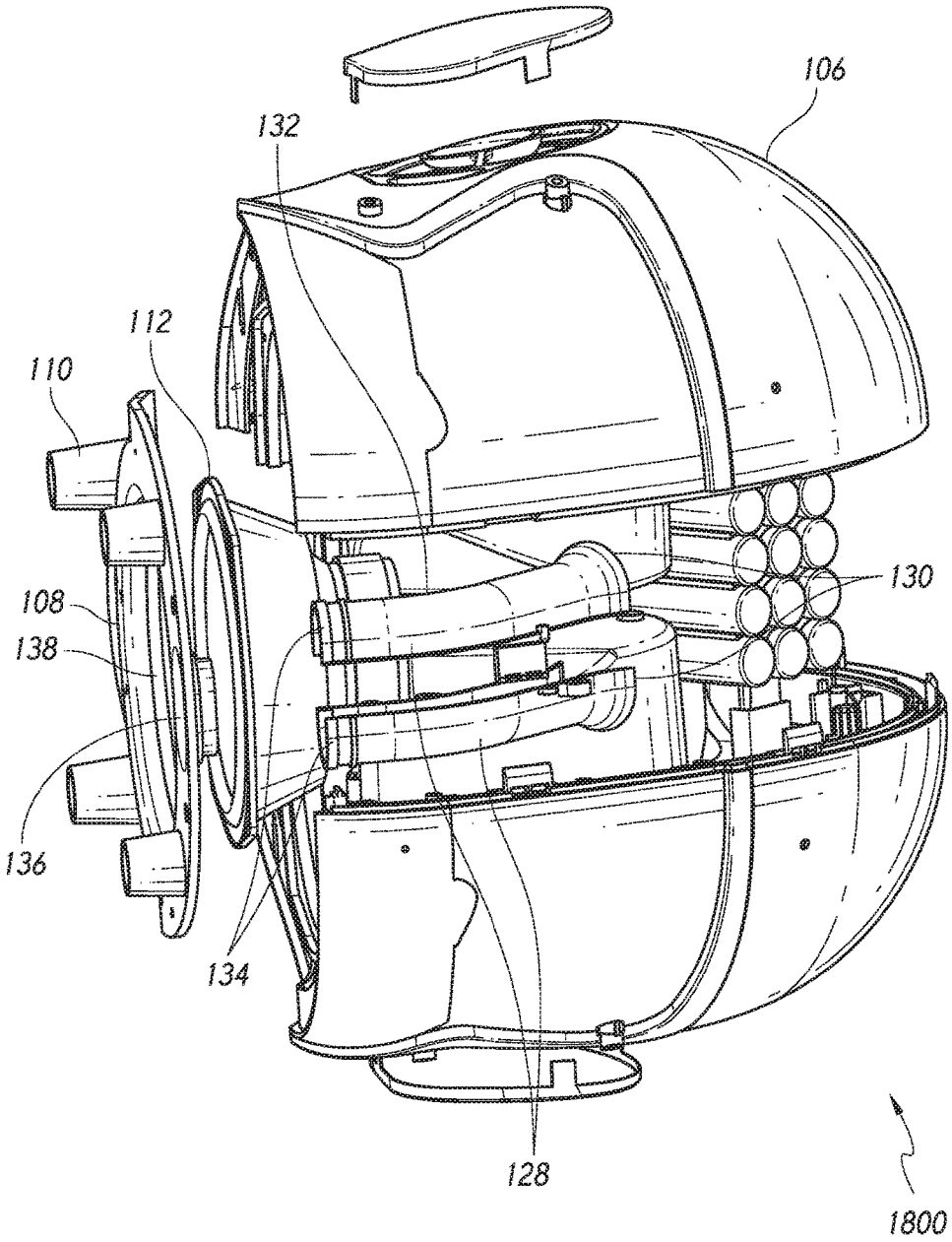
FIG. 18 is a partially exploded view 1800 illustrating sound port 128 including channel, sound port opening 136, low frequency driver 112, and sound port 128 having one end 134 to sound port opening 136 and connection on other end 130 to back 132, behind driver back surface into inner cavity of low frequency driver 112 of a consumer product 101 for Improved 360 Degree Surround Sound Portable Speaker System 100 of FIG. 2 according to an embodiment of the present disclosure of FIG. 1.

FIG. 18 is a partially exploded view 1800 illustrating sound port 128 including channel, sound port opening 136, low frequency driver 112, and sound port 128 having one end 134 to sound port opening 136 and connection on other end 130 to back 132, behind driver back surface into inner cavity of low frequency driver 112 of a consumer product 101 for Improved 360 Degree Surround Sound Portable Speaker System 100 of FIG. 2 according to an embodiment of the present disclosure of FIG. 1.

Figure 19:
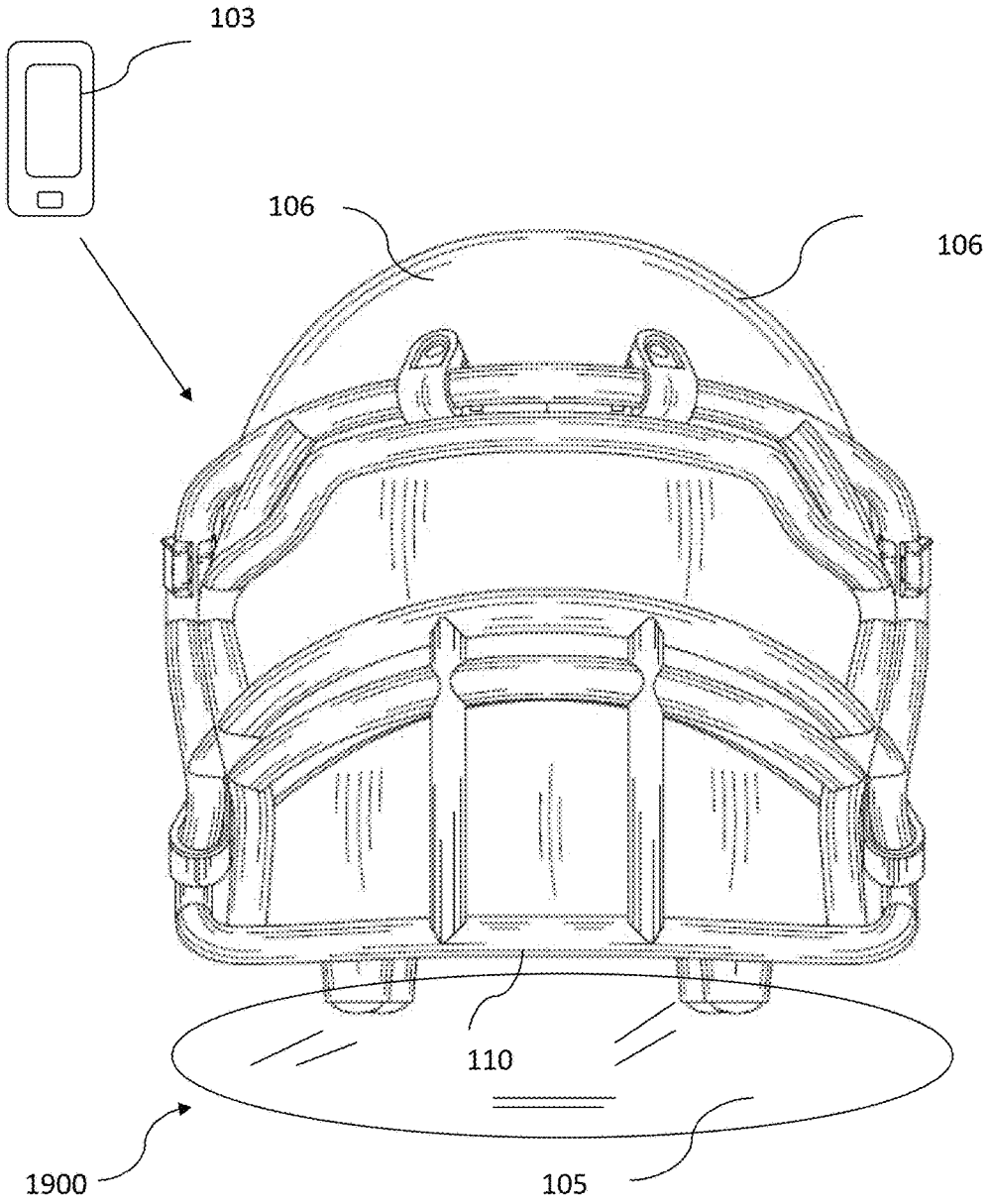
FIG. 19 is a front view 1900 illustrating a consumer product 101 for Improved 360 Degree Surround Sound Portable Speaker System 100 including mobile device 103 that connects therewith and reflective surface 105 utilized by low frequency driver 112 of FIG. 2 according to an embodiment of the present disclosure of FIG. 1.

FIG. 19 is a front view 1900 illustrating a consumer product 101 for Improved 360 Degree Surround Sound Portable Speaker System 100 including mobile device 103 that connects therewith and reflective surface 105 utilized by low frequency driver 112 of FIG. 2 according to an embodiment of the present disclosure of FIG. 1.

Figure 20:
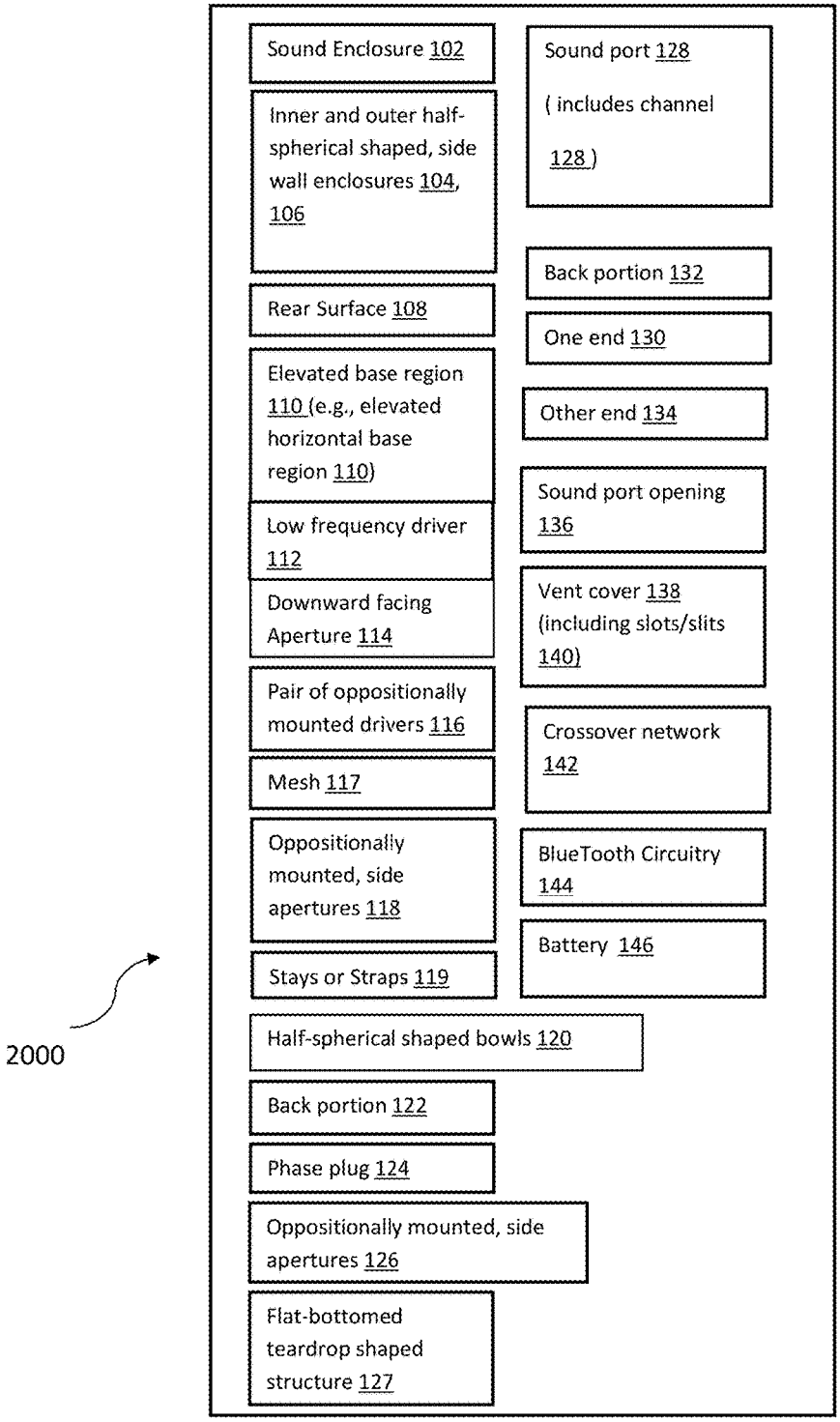
FIG. 20 is a kit 2000 illustrating items of a consumer product 101 for Improved 360 Degree Surround Sound Portable Speaker System 100 of FIG. 2 according to an embodiment of the present disclosure of FIG. 1.

FIG. 20 is a kit 2000 illustrating items of a consumer product 101 for Improved 360 Degree Surround Sound Portable Speaker System 100 of FIG. 2 according to an embodiment of the present disclosure of FIG. 1.

Referring now to FIG. 20, showing Improved 360 Degree Surround Sound Portable Speaker System 100. System 100 may be sold as kit 2000. Kit 2000 includes one or more of the following items: inner and outer half-spherical shaped, side wall enclosures 104, 106; an elevated horizontal base region 110; a pair of oppositionally mounted drivers 116; a low frequency driver 112; a crossover network 142; a vent cover 138 for the low frequency driver 112; half-spherical shaped bowls 120; phase plug 124 including straps or stays 119; sound port 128 including channel, and at least one set of user instructions 136 for assembling the items.

Please note that system 100 can be provided and/or manufactured in numerous sizes and shapes for a multitude of applications, e.g., home office, living room, den, entertainment or the like. It should be appreciated that, upon reading the specification that numerous combination of the items including additions/deletions of items or other arrangements, e.g., colors, sizes, or the like, can be sufficient to disclose the present disclosure.

Figure 21:
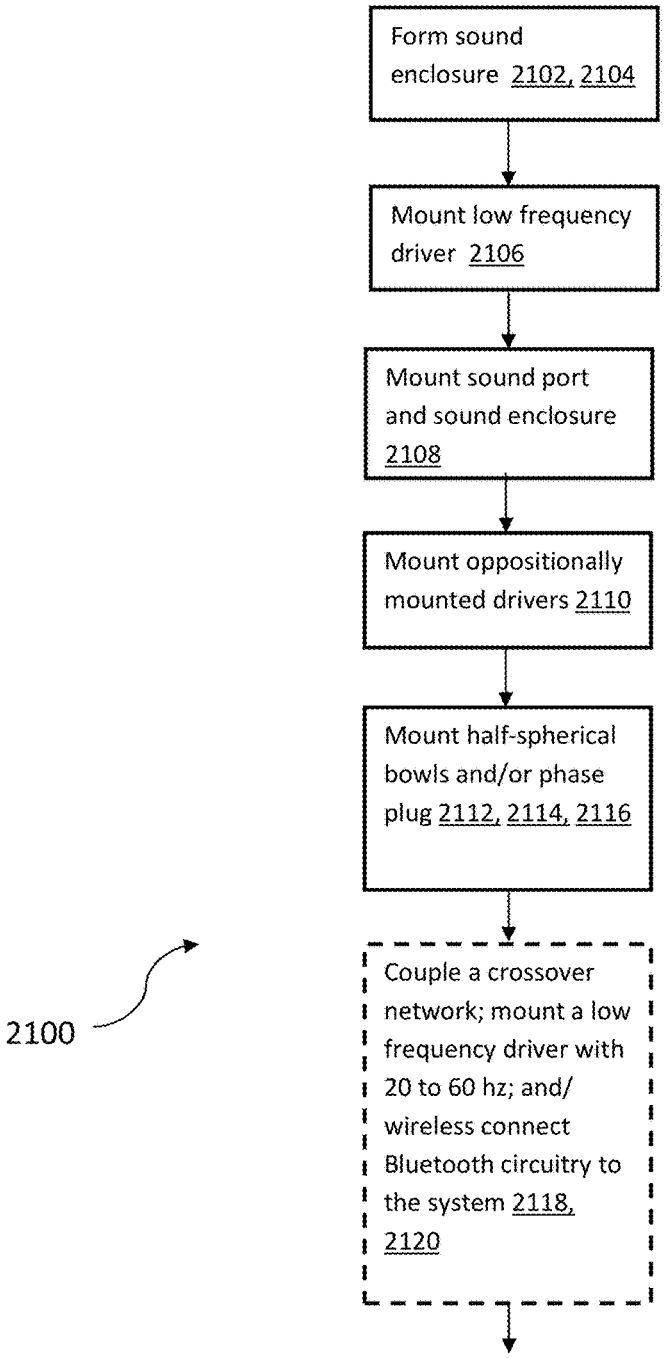
FIG. 21 is a flowchart illustrating a method 2100 of manufacturing Improved 360 Degree Surround Sound Portable Speaker System 100 according to an embodiment of the present disclosure of FIGS. 1-20.

FIG. 21 is a flowchart illustrating a method 2100 of manufacturing Improved 360 Degree Surround Sound Portable Speaker System 100 according to an embodiment of the present disclosure of FIGS. 1-20.

In particular, the method 2100 for manufacturing is disclosed for an improved 360 degree surround sound performance, 100 to 150 output wattage, and low frequency driver portable wireless, Bluetooth compatible system 100 utilizes sound reflective surface 105, including at least one of an lower adjacent surface, a table, and a stand.

In step 2102, form a sound enclosure 102 including inner and outer half-spherical shaped, side wall enclosures 104, 106, and as a bottom surface an elevated horizontal base region 110.

In step 2104, form with the inner half-spherical shaped, side walls 104 and the elevated horizontal base region 110 an air seal that maintains a substantially consistent level of 360 degree sound performance independent of a covering size or a shape of the outer half-spherical shaped, side wall enclosures 106.

In step 2106, mount a low frequency driver 112 facing downward within a downward facing aperture 114 of the inner half-spherical spaced, side wall enclosures 104 and on the rear 108 surface of the elevated base region, e.g., elevated horizontal base region 110. Advantageously, in this configuration, low frequency sounds emitted by the low frequency driver 112 reflect from the sound reflective surface 105, e.g., lower adjacent surface, the elevated base region, e.g., elevated horizontal base region 110, faces and enhance and extend a bass range of the low frequency driver 112.

In step 2108, install a sound port 128 includes a hollow, curved channel mounted within the sound enclosure 102 at one end 130 proximally located to a back portion 132 of the low frequency driver 112 and the at another end mounted to a sound port opening 148 proximal to a vent cover 138 of the elevated horizontal base region 110 and coupled through the elevated horizontal base region 110. Advantageously, vent cover 138 and sound port 128 enhances a volume of and extends a low frequency range, and lowers a resonant frequency of an audio response of the sound enclosure 102. For example, in some embodiments, the vent cover 138 and sound port 128 enhances a volume of, e.g., doubling volume up to 6 dB, extends a low frequency range, and lowers a resonant frequency of the low frequency driver 112.

In step 2110, mount a pair of oppositionally mounted drivers 116, facing outward and within oppositionally facing, side apertures 118 of the inner spaced apart, half-spherical shaped, side wall enclosures 104.

In step 2112, cover using half-spherical shaped bowls 120 a back portion 122 of the oppositionally facing, side apertures 118, and extend a high frequency range of the pair of oppositionally facing drivers 116; wherein the pair of oppositionally mounted drivers 116, facing outward include a paper cone.

In step 2114, couple phase plugs 124 to side apertures 125 via straps of the outer spaced apart, half-spherical shaped, side wall enclosures 106 and mount in front of and spaced-apart from each of the pair of the oppositionally mounted drivers 116, facing outward. Advantageously, the phase plugs 124 extend a high frequency response through guiding audio waves outward toward a listener and prevent the audio waves being destructively interfered near the pair of the oppositionally mounted drivers 116, facing outward. In some embodiments, advantageously, the phase plugs 124 include on a back side a flat-bottom teardrop shaped structure 127 that extend a high frequency response through guiding audio waves outward toward a listener and prevent the audio waves being destructively interfered near the pair of the oppositionally mounted drivers 116, facing outward.

In step 2116, couple a phase plug 124 to side apertures 125 via straps or stays 119 of the outer half-spherical shaped, side wall enclosures 106 and mounted in front of and spaced-apart from each of the pair of the oppositionally mounted drivers 116, facing outward. Advantageously, the phase plug 124 equalizes sound wave path lengths from each of the pair of the oppositionally mounted drivers 116 to the listener and prevents high frequency sound cancellation and thereby improves frequency response of the pair of oppositionally mounted drivers 116. In some embodiments, in some embodiments, the phase plug 124 on a back side including a flat-bottom teardrop shaped structure 127 that equalizes sound wave path lengths from each of the pair of the oppositionally mounted drivers 116 to the listener and prevents high frequency sound cancellation and thereby improves frequency response of the pair of oppositionally mounted drivers 116.

Advantageously, in some embodiments, as illustrated most notably in the FIGS. 9-14, the flat-bottom teardrop shaped structure 127, the phase plug 124, the sound port 128, and the half-spherical shaped bowls 102, e.g., of 10 inch diameter enclosure, can be dimensioned in accordance with size of inner and outer half-spherical shaped, sidewall enclosures 104, 106 so as to maximize sound output, minimize sound reflections, and improve overall sound performance of both low frequency driver 112 and oppositionally mounted driver 116 in accordance with size of a sound enclosure 120, e.g., e.g., 2.5 inch diameter (small, FIGS. 9 and 10), 5 inch diameter (medium, FIGS. 11 and 12), and 10 inch diameter (large, FIGS. 13, 14, and 15) sound enclosure 102.

In step 2118, couple a crossover network 142 including audio amplifiers and filters that separates and amplifies high frequency and low frequency audio signals respectively for each of the pair of oppositionally mounted drivers 116 and the low frequency driver 112. In one example, each of the pair of oppositionally mounted drivers 116 is chosen with a magnetic weight and low frequency audio properties that reduces vibration of the sound enclosure 102 when the low frequency driver 112 is operational.

In step 2120, the method includes any or all the following attributes; namely:

i.) the sound enclosure 102 includes an outward shape and appearance, e.g., including logo of local, regional, state, national, or internationally recognized sports team, of at least one of a sports helmet, a baseball, a basketball, and a soccer ball. In some embodiments, the pair of oppositionally mounted drivers 116 has an aperture size smaller than that of the aperture of the low frequency driver 112;

ii.) the low frequency driver 112 includes an operational frequency range between approximately 20 Hz to 60 Hz and the oppositionally mounted drivers 116 have an operational frequency range between approximately 20 Hz to 20,000 Hz;

iii.) the sound enclosure 102 includes an outward shape and appearance, e.g., including logo of local, regional, state, national, or internationally recognized sports team, of at least one of a sports helmet, a baseball, a basketball, and a soccer ball; the pair of oppositionally mounted drivers 116 includes NIMA wireless speakers; the low frequency driver 112 includes a NIMA wireless speaker; and the crossover network 142 includes a first crossover point between 20 to 60 Hz for the low frequency driver 112 and the pair of oppositionally mounted drivers 116 and adjustable properties; and iv), Bluetooth circuitry 144 wirelessly connects the system to a mobile communication device; wherein the low frequency driver 112 is a subwoofer and the pair of oppositionally mounted drivers 116 is full-range speakers.

It should be noted that step(s) 2118-2120 is/are optional step(s) and may not be utilized, for example, in each and every case. Method 2100 optional steps are illustrated using dotted lines in FIG. 21 that distinguish them from other steps thereof.

It should be noted as herein described in the method, the steps and/or method of contemplated use can be carried out in many different ways, procedures, and the like according to, for example, one or more user preference(s). "[S]tep of" should not be interpreted as "step for", in the claims herein and is not intended to invoke the provisions of 35 U.S.C. §112, ¶6.

Upon reading this specification, it should be appreciated that, under appropriate circumstances, considering such issues as user requirements or wishes, design considerations, marketing preferences, cost(s), structural requirement(s), available materials, technological advances, etc., other methods of use arrangements such as, for example, orders within above-mentioned list that are different, eliminated and/or additional steps, including or eliminating, for example, procedure, process, and/or maintenance step(s), etc., may be sufficient.

It should be apparent, however, to those skilled in the art that many more modifications besides those already described are possible without departing from the disclosed concepts herein. The embodiment, therefore, is not to be restricted except in the spirit of the appended claims. Moreover, in interpreting both the specification and the claims, all terms should be interpreted in the broadest possible manner consistent with the context.

In particular, the terms "comprises" and "comprising" should be interpreted as referring to elements, components, or steps in a non-exclusive manner, indicating that the referenced elements, components, or steps may be present, or utilized, or combined with other elements, components, or steps that are not expressly referenced. Insubstantial changes from the claimed subject matter as viewed by a person with ordinary skill in the art, now known or later devised, and as described herein are expressly contemplated as being equivalent within the scope of the claims and understood by those knowledgeable in the art. Therefore, obvious substitutions now or later known to one with ordinary skill in the art are defined to be within the scope of the defined elements and the reading of the specification as described herein.

The claims are thus to be understood to include what is specifically illustrated and described above, what is conceptually equivalent, what can be obviously substituted and also what essentially incorporates the essential idea of the embodiment. In addition, where the specification and claims refer to at least one of something selected from the group consisting of A, B, C . . . and N, the text should be interpreted as requiring only one element from the group, not A plus N, or B plus N, etc.

What is claimed is new and desired to be protected by Letters Patent is set forth in the appended claims:

1. An improved 360 degree surround sound performance, 100 to 150 output wattage, low frequency driver portable wireless, Bluetooth compatible system utilizing a sound reflective surface including at least one of a lower adjacent surface, a table, and a stand, the system comprising:

a sound enclosure including inner and outer half-spherical shaped, spaced side wall enclosures, and as a bottom surface an elevated horizontal base region, the inner half-spherical shaped, side walls and the elevated horizontal base region form an air seal;

a low frequency mounted driver facing downward within a downward facing aperture of the inner half-spherical shaped, side wall enclosures and on a rear surface of the elevated horizontal base region;

a pair of oppositionally mounted drivers, facing outward and mounted within oppositionally mounted, side apertures of the inner half-spherical shaped, side wall enclosures;

half-spherical shaped bowls coupled to a back portion of the oppositionally mounted, side apertures, respectively, that extends a high frequency range of the pair of oppositionally mounted drivers, facing outward including a paper cone; and a phase plug coupled to side apertures of the outer half-spherical shaped, side wall enclosures via straps and mounted in front of and spaced-apart from each of the pair of the oppositionally mounted drivers, facing outward, the phase plug having on a back side a flat-bottom teardrop shaped structure.

2. The system of claim 1, comprising a sound port including a hollow, curved channel mounted within the sound enclosure with one end proximally located to a back portion of the low frequency mounted driver and with another end mounted to a sound port opening proximal to a vent cover of the elevated horizontal base region and coupled through the elevated horizontal base region; wherein the vent cover and sound port enhances a volume of and extends a low frequency range, and lowers a resonant frequency of an audio response of the sound enclosure.

3. The system of claim 1, comprising a crossover network including audio amplifiers and filters that separates and amplifies high frequency and low frequency audio signals respectively for each of the pair of oppositionally mounted drivers and the low frequency driver.

4. The system of claim 1, wherein each of the pair of oppositionally mounted drivers is chosen with a magnetic weight and low frequency audio properties that reduces vibration of the sound enclosure when the low frequency driver is operational.

5. The system of claim 1, wherein the outer half-spherical shaped, side wall enclosures and the elevated horizontal base region form an outward shape and appearance of at least one of a sports helmet, a baseball, a basketball, and a soccer ball.

6. The system of claim 1, wherein the pair of oppositionally mounted drivers have an aperture size smaller than that of the aperture of the low frequency driver.

7. The system of claim 1, wherein the low frequency driver includes an operational frequency range between approximately 20 Hz to 60 Hz and the oppositionally mounted drivers have an operational frequency range between approximately 20 Hz to 20,000 Hz.

8. The system of claim 1, wherein the outer half-spherical shaped, side wall enclosures and an elevated horizontal base region form an outward shape and appearance of at least one of a sports helmet, a baseball, a basketball, and a soccer ball; the pair of oppositionally mounted drivers includes speakers; the low frequency driver includes a speaker; and the crossover network includes a first crossover point between 20 to 60 Hz for the low frequency driver and the pair of oppositionally mounted drivers and adjustable properties.

9. The system of claim 1, comprising Bluetooth circuitry that wirelessly connects the system to a mobile communication device; wherein the low frequency driver is a subwoofer and the pair of oppositionally mounted drivers is a pair of full-range speakers.

10. An improved 360 degree surround sound performance, 100 to 150 output wattage, low frequency driver portable wireless, Bluetooth compatible system utilizing a sound reflective surface including at least one of an adjacent surface, a table, and a stand, the system comprising:

a sound enclosure including separate inner and outer half-spherical shaped, side wall enclosures, and along a bottom portion an elevated horizontal base region; wherein the inner half-spherical shaped, side walls and the elevated horizontal base region mounted together form an air seal that maintains a substantially consistent level of 360 degree sound performance independent of a covering size or a shape of the outer half-spherical shaped, side wall enclosures;

a pair of oppositionally mounted drivers, facing outward and mounted within oppositionally mounted, side apertures of the inner spaced apart, half-spherical shaped, side wall enclosures; and a low frequency mounted driver facing downward within a downward facing aperture of the inner half-spherical shaped, side wall enclosures and on a rear surface of the elevated horizontal base region;

wherein low frequency sounds emitted by the low frequency mounted driver reflect from the sound reflective surface that the elevated horizontal base region faces and enhance and extend a bass range of the low frequency mounted driver.

11. The system of claim 10, comprising a sound port including a hollow, curved channel mounted within the inner half-spherical shaped, side wall enclosures of the sound enclosure; wherein the hollow, curved channel includes one end proximally located to a back portion of the low frequency mounted driver and another end mounted to a sound port opening proximal to a vent cover of the elevated horizontal base region and coupled through the elevated horizontal base region; wherein the vent cover and the sound port enhances a volume of and extends a low frequency range, and lowers a resonant frequency of an audio response of the sound enclosure.

12. The system of claim 10, wherein the oppositionally mounted, side apertures include half-spherical shaped bowls that cover a back portion of the oppositionally mounted, side apertures, and extend a high frequency range of the pair of oppositionally mounted drivers, facing outward; wherein the pair of oppositionally mounted drivers, facing outward includes a paper cone.

13. The system of claim 10, comprising a phase plug coupled to sides of outer side apertures via straps and mounted in front of and spaced-apart from each of the pair of the oppositionally mounted drivers, facing outward; wherein the phase plug extends a high frequency response through guiding audio waves outward toward a listener and prevent the audio waves being destructively interfered near the pair of the oppositionally mounted drivers, facing outward.

14. The system of claim 10, comprising a phase plug coupled to sides of outer side apertures via straps and mounted in front of and spaced-apart from each of the pair of the oppositionally mounted drivers, facing outward, the phase plug having on a back side a flat-bottom teardrop shaped structure which equalizes sound wave path lengths from each of the pair of the oppositionally mounted drivers to the listener and prevents high frequency sound cancellation and improves frequency response of the pair of oppositionally mounted drivers.

15. The system of claim 10, comprising a crossover network including audio amplifiers and filters that separates and amplifies high frequency and low frequency audio signals respectively for each of the pair of oppositionally mounted drivers and the low frequency driver.

16. The system of claim 10, wherein each of the pair of oppositionally mounted drivers is chosen with a magnetic weight and low frequency audio properties that reduces vibration of the sound enclosure when the low frequency driver is operational.

17. The system of claim 10, wherein the sound enclosure forms an outward shape and appearance, including a logo of local, regional, state, national, or internationally recognized sports team, of at least one of a sports helmet, a baseball, a basketball, and a soccer ball.

18. The system of claim 10, wherein the pair of oppositionally mounted drivers have an aperture size smaller than that of the aperture of the low frequency driver.

19. The system of claim 10, wherein the low frequency driver includes an operational frequency range between approximately 20 Hz to 60 Hz and the oppositionally mounted drivers have an operational frequency range between approximately 20 Hz to 20,000 Hz.

20. The system of claim 10, wherein the sound enclosure forms an outward shape and appearance, including logo of local, regional, state, national, or internationally recognized sports team, of at least one of a sports helmet, a baseball, a basketball, and a soccer ball; the pair of oppositionally mounted drivers includes speakers; the low frequency driver includes a speaker; and the crossover network includes a first crossover point between 20 to 60 Hz for the low frequency driver and the pair of oppositionally mounted drivers and adjustable properties.

21. The system of claim 10, comprising Bluetooth circuitry that wirelessly connects the system to a mobile communication device; wherein the low frequency driver is a subwoofer and the pair of oppositionally mounted drivers is a pair of full-range speakers.

* * * * *